US005967098A

United States Patent [19]

Tanca et al.

[11] Patent Number: 5,967,098

[45] Date of Patent: Oct. 19, 1999

[54] OIL SHALE FLUIDIZED BED

[76] Inventors: Michael C. Tanca, 32 Hayes Rd., Tariffville, Conn. 06081; Mark S. Zak, 11 bedford Ave. Apt. K-3, Norwalk, Conn. 06850

[21] Appl. No.: 09/102,184

[22] Filed: Jun. 22, 1998

[51] Int. Cl.[6] ..... F22B 1/00

[52] U.S. Cl. ..... 122/4 D; 110/245

[58] Field of Search ..... 122/4 D; 110/245

[56] References Cited

U.S. PATENT DOCUMENTS

| | | | |
|---|---|---|---|
| 4,111,158 | 9/1978 | Reh et al. | 122/4 D |
| 4,165,717 | 8/1979 | Reh et al. | 122/4 D |
| 4,377,394 | 3/1983 | Muenger et al. | 122/5 |
| 4,565,139 | 1/1986 | Sage et al. | 122/4 D |
| 4,579,070 | 4/1986 | Lin et al. | 122/4 D |
| 4,716,856 | 1/1988 | Beisswenger et al. | 122/4 D |
| 4,817,563 | 4/1989 | Beisswenger et al. | 122/4 D |
| 4,854,249 | 8/1989 | Khinkis et al. | 122/4 D |
| 5,159,886 | 11/1992 | Schaub et al. | 122/4 D |
| 5,341,766 | 8/1994 | Hyppanen | 122/4 D |

*Primary Examiner*—Teresa Walberg
*Assistant Examiner*—Jiping Lu
*Attorney, Agent, or Firm*—Arthur E. Fournier, Jr.

[57] ABSTRACT

A fluidized bed combustion system is disclosed and in particular a fluidized bed combustion system particularly well suited for the combustion of oil shale, generating steam thereby. The fluidized bed combustion system includes a furnace volume having a multi-chambered upper segment thereof, a deentrainment zone, a fluidized bed having a plurality of isolatable segments thereof, a fluidized bed ash cooler having a plurality of isolatable segments thereof wherein the fluidized bed ash cooler is in fluid communication with the furnace volume, a fuel supply means in fluid communication with the furnace volume for delivering oil shale thereto for combustion therein, a backpass volume defined by a plurality of backpass wall tubes integral to a thermodynamic steam cycle and in fluid flow relation with the furnace volume and a plurality of circulatory fluid flow paths integral to a thermodynamic steam cycle and operative to conduct the flow of steam or water therethrough.

9 Claims, 8 Drawing Sheets

OIL SHALE FLUIDIZED BED

BACKGROUND OF THE INVENTION

This invention relates to fluidized bed combustion (FBC) systems, and more particularly to a bubbling fluidized bed (BFB) combustion system that is particularly well suited for the purpose of effecting the combustion therein of oil shale and generating steam thereby.

The use of fluidized beds is widespread in industry. They have been used for such diverse purposes as coal gasification, chemical pulping, gas phase polymerization and catalytic cracking. It has also been known in the prior art to provide fluidized beds of various types in the generation of steam. In this regard, one convenient method of differentiating between such types of fluidized bed combustion systems is by the nature of the fluidization that takes place therein. As employed in this context, the term "fluidization" refers to the manner in which solid particulate material is provided with a free-flowing, fluid like behavior. To this end, as a fluidizing gas is made to pass vertically in a fluidized bed combustion system through a bed of solid particles, such a flow of gases produces forces that tend to separate the solid particles from one another. At low gas velocities such forces can be insufficient to cause the solid particles to separate from one another such that the solid particles tend to remain in contact with one another, i.e., there is still a tendency for the particles to resist movement therebetween. When such a condition exists, it is referred to as a fixed bed and combustion systems employing this particular technique are referred to as fixed bed fluidized bed combustion systems. On the other hand, as the velocity of the fluidizing gas is increased, a point is reached wherein such velocity is sufficient to produce forces, acting upon the solid particles, adequate to cause separation of the solid particles. When this occurs, the bed of solid particles becomes fluidized in that a gas cushion between the solid particles permits the solid particles to move freely, thus giving the bed of solid particles liquid-like characteristics.

The state of fluidization in a fluidized bed combustion system depends mainly upon the bed-particle diameter and the velocity of the fluidizing gas. At relatively low fluidizing gas velocities and with coarse bed-particle size, the fluidized bed is relatively dense with a relatively uniform solids concentration, and has a well defined surface. This is commonly referred to as a bubbling fluidized bed (BFB), because the fluidizing gas in excess of that required to fluidize the bed passes through the bed in the form of bubbles. The bubbling fluidized bed is further characterized by a modest bed solids mixing rate, and a relatively low entrainment of solids in subsequent flue gases. At higher fluidizing gas velocities and with finer bed-particle size, the fluidized bed surface becomes more diffuse as the entrainment of solids in the flue gases increases, such that there is no longer a well defined bed surface. At still higher fluidizing gas velocities, substantially complete entrainment of bed solids occurs and recycling of the entrained material to the bed is required in order to maintain bed-particle inventory. Also, with increasing fluidizing gas velocities, the bulk density of the bed decreases with height in the furnace volume. A fluidized bed with these characteristics is referred to as a circulating fluidized bed (CFB) because of the high rate of bed material recirculation.

Inasmuch as the subject of the present application is directed to bubbling fluidized bed combustion systems, the discussion hereinafter will be presented in that context. Fluidized bed combustion systems, including, but not limited to, bubbling fluidized bed (BFB) combustion systems, are normally intended to be operative to produce steam. Moreover, such production of steam results from the combustion of fuel and air within the furnace volume of a fluidized bed combustion system. Furthermore, the steam that is so produced is designed to be operative to function in accordance with a preselected thermodynamic steam cycle.

The design of fluidized bed combustion systems is generally such that, for the purposes of the combustion that takes place therewithin, fuel is burned in a bed of hot, incombustible particles, the latter particles being suspended by the upward flow of a fluidizing gas. Moreover, this fluidizing gas is comprised of both air, which is being supplied to the fluidized bed combustion system to support the combustion of fuel therewithin, and, if need be, the gaseous byproducts which result from the combustion of the fuel and air. The combustion is accomplished in a furnace volume. A bubbling fluidized bed combustion system includes a furnace volume, the walls of which are comprised of vertical waterwall tubes. In the lower segment of the furnace volume, fuel, and possibly sorbent are mixed with and burned in air and the aforesaid fluidizing gas, producing thereby hot combustion gases which rise within the furnace volume. As the hot combustion gases, more commonly referred to now as flue gases, rise within the furnace volume, heat is transferred therefrom to the waterwall tubes, integral to the thermodynamic steam cycle, causing steam to be evaporatively produced from water rising within the waterwall tubes. A mixture of steam and water is conveyed from the upper segment of the waterwall tubes to a steam drum for separation therein. From the steam drum, the water portion of the water/steam mixture is returned to the waterwall tubes in the lower segment of the furnace volume completing a water-evaporative steam loop. In addition, it may be such that similar, additional water-evaporative steam loops are utilized in the thermodynamic steam cycle. In either case the steam portion of the water/steam mixtures is conveyed from the steam drum to other components of the thermodynamic steam cycle to which reference will be made hereinafter.

Continuing with the description of the flow of the aforesaid flue gases through the bubbling fluidized bed steam combustion system, it is noted that depending upon the needs of the thermodynamic steam cycle, the upper segment of the furnace volume may be divided into multiple chambers, each separately in fluid communication with the lower segment of the furnace volume and operative to allow the flow of flue gases therethrough. Said multiple chambers contain additional heat exchange means for the purpose of superheating and reheating, i.e., further superheating, steam as part of the thermodynamic steam cycle. Further reference will be made to this superheating and reheating momentarily.

From the top of the furnace volume, the flue gases still contain useful energy and are directed to a backpass volume wherein still further heat exchange means are located. These heat exchange means typically comprise economizer heat exchange means and have flowing therethrough water, condensed from steam expanded in a turbine. This water is heated due to an exchange of heat that takes place between the still relatively hot flue gases flowing through the backpass volume and the relatively cool economizer heat exchange means disposed therein. The now heated water is then conveyed from the economizer heat exchange means to the steam drum for continued use in the thermodynamic steam cycle. The flue gases during the passage thereof through the backpass volume are cooled as a consequence of the exchange of heat that takes place between the still relatively hot flue gases and the relatively cool economizer heat exchange means. Upon exiting the backpass volume the now cooler flue gases are commonly made to flow to an air preheater wherein air is heated prior to use in the aforesaid combustion process in the lower segment of the furnace volume. Thereafter, the flue gases are commonly made to flow, in known fashion, to and through a flue gas cleaning apparatus after which the flue gases are emitted to the atmosphere via a stack. The latter completes the description of the flue gas flow path in the bubbling fluidized bed combustion system.

Returning to the description of the fluid circuitry of the thermodynamic steam cycle, the steam portion of the water/steam mixtures is typically conveyed from the steam drum to a plurality of steam cooled backpass wall tubes which define the backpass volume. The aforesaid steam, during passage thereof through the steam cooled backpass wall tubes, is superheated as a consequence of an exchange of heat that takes place between the steam and the relatively hot flue gases flowing through the backpass volume. Upon exiting the steam cooled backpass wall tubes the now superheated steam is made to flow to a first chamber of the aforementioned multi-chambered upper segment of the furnace volume. Said steam is then made to flow through a plurality of superheat heat exchange means disposed therein and operative to further superheat the steam. The superheated steam is thence made to flow to a high pressure turbine (HPT) for expansion therein. After expansion within the high pressure turbine the still superheated steam is made to flow to a second chamber of the aforementioned multi-chambered upper segment of the furnace volume. The still superheated steam is then made to flow through a plurality of reheat heat exchange means disposed therein and operative to again superheat the steam. The again superheated steam, now commonly referred to as reheated steam, is thence made to flow to a low pressure turbine (LPT) for expansion therein. After expansion in the low pressure turbine the reheated steam is still in a superheated state and is thence made to flow to a condenser where the steam condenses to water. The water is thence made to flow, via conventional fluid flow means, from the condenser to the economizer heat exchange means located in the backpass volume. The water is heated in the economizer heat exchange means as a consequence of an exchange of heat that takes place between the aforesaid water and the still relatively hot flue gases passing through the backpass volume. The heated water is thence made to flow from the economizer heat exchange means to the steam drum for further use in the thermodynamic steam cycle. It is noted that it may also be the case that the aforesaid additional heat exchange means, located in the lower segment of the furnace volume, are made part of the water-superheated steam loop. The foregoing then completes the description of the fluid circuitry of the thermodynamic steam cycle in the bubbling fluidized bed combustion system.

It should therefore be obvious from the foregoing that the production of steam from a bubbling fluidized bed combustion system involves both a combustion process and a thermodynamic steam cycle acting in cooperative association therebetween.

The prior art is replete with examples of the use of fluidized bed combustion systems in the generation of steam. Such examples include, but are not limited to, circulating fluidized bed (CFB) systems, pressurized fluidized bed (PFB) systems and internal circulating fluidized bed (ICFB) systems as well as bubbling fluidized bed (BFB) systems. Representative of such fluidized bed combustion systems is U.S. Pat. No. 5,138,982, entitled "Internal Circulating Fluidized Bed Type Boiler And Method Of Controlling The Same," which issued on Aug. 18, 1992 and relates to an apparatus for incinerating coal, anthracite, coal dressing sludge, petro coke, bark, bagasse, industrial waste, municipal waste and other combustibles using a so-called circulating type fluidized bed as well as for recovering thermal energy from the fluidized bed, and a method of controlling the amount of diffusion gas to be blown into a thermal energy recovery chamber and the amount of fuel to be supplied in order to regulate the amount of thermal energy recovered and to maintain a constant temperature in the primary incinerating chamber of the fluidized bed. Also in the prior art, U.S. Pat. No. 5,146,878, entitled "Boiler And A Supported Heat Transfer Bank," issued on Sep. 15, 1992 and discloses a boiler, having a reaction chamber with heat transfer panels or tube banks, formed by several horizontal heat transfer tubes attached one on top of the other, and in which the ends of the heat transfer panels or the tube banks are supported by two opposing walls defining the reaction chamber. Still further in the prior art, U.S. Pat. No. 5,203,159, entitled "Pressurized Fluidized Bed Combustion Combined Cycle Power Plant and Method of Operating The Same," issued on Apr. 20, 1993, and is directed to a pressurized fluidized bed combustion combined cycle power plant and method of operating the same; more particularly to a combined cycle power plant comprising a pressurized fluidized bed combustion boiler, combustion boiler for burning coal and producing steam, a gas turbine, a compressor and a generator, with the steam being usable to drive a steam turbine and with means being provided for maintaining a stable fluidization in the pressurized fluidized bed combustion boiler even at partial load. Yet further in the prior art, U.S. Pat. No. 5,255,507, entitled "Combined Cycle Power Pant Incorporating Atmospheric Circulating Fluidized Bed Boiler And Gasifier," issued on Oct. 26, 1993 and relates to circulating fluidized bed boilers and pertains particularly to a combined cycle power plant incorporating an atmospheric circulating fluidized bed boiler and gasifier. Further representative of the prior art with respect to the use of fluidized bed combustion systems in the generation of steam is U.S. Pat. No. 5,273,000, entitled "Reheat Steam Temperature Control In A Circulating Fluidized Bed Steam Generator." U.S. Pat. No. 5,273,000, issued on Dec. 28, 1993, is assigned to the same assignee as the present invention and discloses a method for the fluidized bed combustion of a fuel in a circulating fluidized bed system and particularly to a method for controlling the extraction of heat from the recycle solids to control the temperature of a fluid such as reheated steam. Still further in the prior art, U.S. Pat. No. 5,471,955, entitled "Fluidized Bed Combustion System Having A Heat Exchanger In The Upper Furnace," issued on Dec. 5, 1995 and relates to a fluidized bed combustion system and method, and, more particularly, to such a system and method in which a heat exchanger is provided in the upper portion of the furnace. Yet further in the prior art, U.S. Pat. No. 5,533,471, entitled "Fluidized Bed Reactor And Method Of Operation Thereof," issued on Jul. 9, 1996 and relates to controlled operation of a circulating fluidized bed reactor that has a number of advantages compared to prior art construction and processes.

More specifically, the prior art also reveals reference to bubbling fluidized bed combustion systems for use in the generation of steam. In particular, U.S. Pat. No. 4,103,646, entitled "Apparatus And Method For Combusting Carbonaceous Fuels Employing In Tandem a Fast Bed Boiler And A Slow Bed Boiler," issued on Aug. 1, 1978 and discloses an invention in which a fluid bed boiler and combustion method are provided having two zones. Still further in the prior art, U.S. Pat. No. 4,325,327, entitled "Hybrid Fluidized Bed Combustor," issued on Apr. 20, 1982 and is assigned to the same assignee as the present invention and embodies a system which includes a furnace whose source of heat is an atmospheric bubbling fluidized bed burning crushed solid fuel. Yet further in the prior art, U.S. Pat. No. 5,526,775, entitled "Circulating Fluidized Bed Reactor And Method Of Operating The Same," issued on Jun. 18, 1996 and relates to a circulating fluidized bed reactor having substantially vertical walls with cooling elements therein, the vertical walls defining the interior of the reactor chamber; means for introducing fluidizing gas at the bottom of the fluidizing bed reactor; means for introducing particulate matter into said reactor; separator for separating particulate material from the gases, the separator being in connection with said reactor at the upper section thereof; return duct, being connected to the separator; bubbling fluidized bed adjacent to the reactor and being provided with heat exchanger means for cooling particulate material, side walls, and rear and front wall shaving cooling elements in fluid communication with the cooling elements of the reactor, said bubbling fluidized bed being connected with said return duct.

Fluidized bed combustion systems are known to be flexible in their ability to burn a wide variety of fuel types. Included in these fuels is pulverized coal, anthracite, sludge, petro coke, bagasse, bark, and industrial and municipal wastes. Representative of the utilization of such fuel types in fluidized bed combustion systems is found in U.S. Pat. No. 5,138,958, entitled "Process For Incinerating Domestic Refuse In A Fluidized Bed Furnace," which issued on Aug. 18, 1992. In accordance with the teachings of U.S. Pat. No. 5,138,958, a process for incinerating domestic refuse is implemented in a boiler comprising a fluidized bed furnace over which is a post-combustion chamber. Also in the prior art, reference is again made to U.S. Pat. No. 5,138,982. Yet further in the prior art, U.S. Pat. No. 5,156,099 entitled, "Composite Recycling Type Fluidized Bed Boiler," issued on Oct. 20, 1992 and relates to an internal recycling type fluidized bed boiler in which combustion materials such as various coals, low grade coal, dressing sludge, oil cokes and the like are burnt by a so-called whirling flow fluidized bed, the interior of a freeboard and a heat transfer portion provided downstream of the freeboard portion. Still further in the prior art U.S. Pat. No. 5,189,964, entitled "Process For Burning High Ash Particulate Fuel," issued on Mar. 2, 1993 and relates to fuel combustion in stationary power generating plants; and more particularly to particulate carbonaceous fuel and the use thereof in fluidized-bed combustion processes. Continuing in the prior art with respect to the burning of various types of fuel in fluidized bed combustion systems, U.S. Pat. No. 5,365,889, entitled "Fluidized Bed Reactor And System And Method Utilizing Same," issued on Nov. 22, 1994 and relates to an improved fluidized bed reactor and method, and more particularly, to a fluidized bed reactor and method for incinerating combustible materials such as municipal and industrial wastes. Yet further in the prior art, U.S. Pat. No. 5,395,596, entitled "Fluidized Bed Reactor And Method Utilizing Refuse Derived Fuel," issued on Mar. 7, 1995 and relates to a fluidized bed reactor and method of operating a fluidized bed reactor and, more particularly, to such a reactor and method in which the reactor is fueled in whole or in part by refuse derived fuel, or RDF. The prior art with respect to the utilization of a wide variety of fuels in fluidized bed combustion systems also reveals U.S. Pat. No. 4,449,482, entitled "Fluidized Bed Boilers." U.S. Pat. No. 4,449,482 issued on May 22, 1984 and relates to fluidized bed boilers. In accordance with the teachings of U.S. Pat. No. 4,449,482, in reactors generating hot gases, air is passed through a bed of particulate material which includes a mixture of inert material and a fuel material such as coal, wood waste or other combustible materials. Yet still further the prior art shows U.S. Pat. No. 4,823,712, entitled "Multifuel Bubbling Bed Fluidized Bed Combustion System," issued on Apr. 25, 1989 and relates to providing multifuel capability for a fluidized bed combustor and related methods and apparatus for combusting low-BTU fuels and generating high-temperature gases while reducing environmental pollutants. The prior art relating to the burning of various fuel types in fluidized bed combustion systems also reveals U.S. Pat. No. 5,313,913, entitled "Pressurized Internal Circulating Fluidized-Bed Boiler" which issued on May 24, 1994 and relates to a pressurized fluidized-bed combined cycle electric generating system in which a fuel such as coal, petro coke, or the like is combusted in a pressurized fluidized bed and an exhaust gas produced by the combusted fuel is introduced into a gas turbine. Continuing in the prior art, U.S. Pat. No. 5,513,599, entitled "Pressurized Internal Circulating Fluidized Bed Boiler," issued on May 7, 1996 and relates to a pressurized fluidized-bed boiler, and more particularly to a pressurized internal circulating fluidized-bed boiler for use in a pressurized fluidized-bed combined-cycle electric generating system in which a fuel such as coal, petro coke, or the like is combusted in a pressurized fluidized bed and an exhaust gas produced by the combusted fuel is introduced into a gas turbine.

It has been long known and practiced in the prior art to utilize oil bearing shale in a retorting process, i.e., in the extraction of various oils, gases and vapors therefrom. By driving off and then condensing volatiles found in the shale, light petroleum products such as gasoline may be derived from the shale. However, such a retorting process is distinct from the use of shale as a fuel in a fluidized bed combustion system wherein the entirety of the shale is burned and byproduct thereof are not sought. Representative of the prior art with respect to oil shale retorting is seen in U.S. Pat. No. 1,451,575, entitled "Oil Shale Retort," which issued on Apr. 10, 1923. In accordance with the teachings of U.S. Pat. No. 1,451,575 the invention therein relates to an apparatus for and process of distilling or separating the oil contained in oil shale, asphalt or other oil bearing mineral, from the solid or residual matter thereof and is particularly designed for use in refining plants in which oil shale is treated for the purpose of extracting its oil contents. Still further in the prior art, U.S. Pat. No. 1,465,277, entitled "Apparatus For Extracting Oil From Shales," issued on Aug. 21, 1923 and relates to a process, mechanism and retort adapted to receive crushed or powdered shale in suitable quantities, to heat and drive off the oil elements as a gas undeprived of its qualities, the gas being later condensed and stored as oil in containers such as may be provided. Continuing in the prior art, U.S. Pat. No. 2,774,726, entitled "Apparatus For The Recovery Of Oil And Gaseous Products From Shale," issued on Dec. 18, 1956 and relates to a method and apparatus for the recovery of oil and gaseous products from shale. Yet further in the prior art, U.S. Pat. No. 4,409,092, entitled "Combination Process For Upgrading Oil Products Of Coal, Shale Oil And Crude Oil To Produce Jet Fuels, Diesel Fuels And Gasoline," issued on Oct. 11, 1983 and relates to a method and combination of processing steps for producing jet fuels from hydrocarbon materials derived from oil shale, coal and crude oil. Further in the prior art, U.S. Pat. No. 4,438,816, entitled "Process For Recovery Of Hydrocarbons From Oil Shale,"

issued on Mar. 27, 1984 and relates to the processing of oil shale in a manner in which allows the recovery of a high percentage of the hydrocarbonaceous oil which is contained therein.

The use of oil shale in conjunction with fluidized bed systems is also found in the prior art. U.S. Pat. No. 4,373,454, entitled "Oil Shale Retorting And Combustion System," issued on Feb. 15, 1983 and relates to a fluidized bed system in which oil shale containing calcium carbonate is subject to sequentially occurring (two-stage) retorting and combustion steps whereby volatile hydrocarbons representing maximum heat value may be extracted from the oil shale prior to the occurrence of any calcination reaction so as to extensively increase the efficiency of the energy extraction process relating to oil shale. Further in the prior art, U.S. Pat. No. 4,481,080, entitled "Staged Fluidized Combustion," issued on Nov. 6, 1984 and relates to oil shale retorting and more particularly to staged fluidized bed oil shale retorting.

To summarize, it should be evident from the foregoing broad array of prior art that fluidized beds are utilized in numerous capacities, including the generation of steam. In particular, circulating fluidized beds, pressurized fluidized beds, internal circulating fluidized beds and bubbling fluidized beds are but a few of the fluidized bed combustion systems utilized in the generation of steam. Furthermore, the prior art shows that fluidized bed combustion systems, while utilized in the generation of steam, are capable of burning a wide variety of fuels including pulverized coal, anthracite, sludge, petro coke, bagasse, bark, and industrial and municipal wastes. Still further, the prior art shows that oil shale is utilized for purposes other than in the generation of steam, such as in the extraction therefrom of various oils, gases and vapors in contexts other than as a fuel in fluidized bed combustion systems, e.g., in retorting oil shale.

However, in canvassing the prior art it should be readily apparent that, although fluidized bed combustion systems, when utilized in the generation of steam and constructed in accordance with the teachings of the U.S. patents to which reference has been made, have been demonstrated to be operative for the purpose for which they were designed, there has nevertheless been evidenced in the prior art that there exists a need for such fluidized bed combustion systems to be improved. More specifically, a need has been evidenced in the prior art relating to the generation of steam by fluidized bed combustion systems that there exists a need for a new and improved fluidized bed combustion system in the nature of a bubbling fluidized bed combustion system capable of effecting therein the combustion of a highly reactive fuel having a high ash content, a low higher heating value (HHV), a high limestone ($CaCO_3$) content and having a tendency to foul convective heat transfer surfaces.

Moreover, such a new and improved bubbling fluidized bed combustion system, capable of utilizing shale oil as a fuel therein and generating steam thereby, would be particularly characterized in a number of respects. To that end, one such characteristic which such a new and improved bubbling fluidized bed combustion system would desirably possess is that of a bubbling bed of hot solids disposed within the lower segment of the furnace volume. It is also desirable that such a bubbling bed of hot solids include therein a plurality of isolatable segments. Furthermore, it is desirable that the bubbling bed of hot solids be capable of being slumped, i.e., capable of having one or more of said segments thereof isolated and made inoperative for the purpose of operating the bubbling fluidized bed combustion system so as to effectively respond to changing demands placed thereupon. Still further, it is desirable that such a bubbling bed of hot solids be capable of containing, in such a plurality of isolatable segments thereof, a plurality of heat exchange means for use either in a water-evaporative steam loop, or in a water-superheated steam loop in the thermodynamic steam cycle. By so incorporating such heat exchange means in the isolatable segments of the bubbling bed of hot solids, flue gas temperatures in the furnace volume may be effectively controlled. By so controlling the flue gas temperatures the bubbling fluidized bed combustion system may be operated at a lower flue gas temperature, thus reducing the aforesaid fouling of convective heat exchange means and reducing the tendency of the bed solids to agglomerate.

Still further, a characteristic which such a new and improved bubbling fluidized bed combustion system would desirably possess is that of a deentrainment zone disposed in the lower segment of the furnace volume. Such a deentrainment zone would be characterized by an increasing cross sectional area with increasing height within the furnace volume such that larger particulate matter, i.e., larger unburned oil shale particles entrained within the upwardly mobile flue gases, fall out of the flue gas stream and are recirculated to the bubbling bed of hot solids for continued combustion. Such a deentrainment zone also increases the residence time of a particle of fuel, thereby providing for the greater likelihood of combustion of a particle of fuel. Furthermore, such a deentrainment zone reduces the amount of fly ash carried away in the flue gas stream, thus reducing the amount of fouling of convective heat transfer surfaces as well as increasing sulfur capture and carbon burnout.

Furthermore, a characteristic which such a new and improved bubbling fluidized bed combustion system would desirably possess is that of the presence of freeboard heat exchange means disposed in the lower segment of the furnace volume above the deentrainment zone. Such freeboard heat exchange means should be capable of heat transfer duty either in a water-evaporative steam loop, or in a water-superheated steam loop in the thermodynamic steam cycle. Furthermore, such freeboard heat exchange means are disposed parallel to the flow of the upwardly mobile flue gases and act to remove heat therein released thereto due to the combustion of oil shale. The freeboard heat exchange means also provide effective control of the temperature of the upwardly mobile flue gases in the furnace volume so as to allow the fluidized bed combustion system to be operated at a lower flue gas temperature, thus reducing the potential for the aforesaid fouling of convective heat exchange means.

Another characteristic which such a new and improved bubbling fluidized bed combustion system would desirably possess is that of a fluidized bed ash cooler incorporated as an integral part thereof wherein the fluidized bed ash cooler acts as a heat exchanger. It is desirable that such a fluidized bed ash cooler be capable of accepting as input thereto relatively hot ash particles, originating from the bubbling bed of hot solids and resulting from the incomplete combustion of oil shale within the furnace volume. Still further, such a fluidized bed ash cooler should be capable of accepting as fluid input thereto relatively cool air, for exchanging heat therein with the aforesaid relatively hot ash particles. Thereupon, the now hotter air is delivered therefrom to either the aforesaid bubbling bed of hot solids or to an overbed air inlet means disposed above the bubbling bed of hot solids in the lower segment of the furnace volume. Such an exchange of heat between the air and the relatively hot ash recovers still useful energy from the relatively hot ash for further use in the flue gas flow path or the thermodynamic steam cycle, thus improving the efficiency of the bubbling fluidized bed combustion system. Furthermore, it is desirable that such a fluidized bed ash cooler be capable of classifying finer ash particles from coarser ash particles and returning the finer ash particles directly to the bubbling bed of hot solids while yet delivering the coarser ash particles to an ash discharge means. Yet further, it is desirable that such a fluidized bed ash cooler be capable of performing heat transfer duty either in a water-evaporative steam loop, or in a water-superheated steam loop in the aforesaid thermodynamic steam cycle. It is also desirable that such a fluidized bed ash cooler include therein a plurality of isolatable segments thereof. Still further, it is desirable that such a fluidized bed ash cooler be capable of being slumped, i.e., capable of having one or more of said segments thereof isolated and made inoperative for the purpose of operating the bubbling fluidized bed combustion system so as to effectively respond to changing demands placed thereupon, while yet maintaining the aforesaid classification capability.

Yet another characteristic which such a new and improved bubbling fluidized bed combustion system would desirably possess is that of a multi-chambered upper segment of the furnace volume; each chamber therein being in fluid communication with the lower segment of the furnace volume. In particular it is desirable that such multi-chambered upper segment of the furnace volume comprise for example two chambers whereby a first chamber thereof contains a plurality of superheat heat exchange means in fluid communication therebetween and integral to the aforesaid thermodynamic steam cycle and a second chamber thereof contains a plurality of reheat heat exchange means in fluid communication therebetween and integral to the thermodynamic steam cycle. Still further it is desirable that such a multi-chambered upper segment of the furnace volume have operatively connected thereto, means for controlling the distribution of the flow of the aforesaid upwardly mobile flue gases between and through the first and second chambers thereof and controlling thereby the reheated steam outlet (RHO) temperature of the thermodynamic steam cycle.

Another desirable characteristic that such a new and improved bubbling fluidized bed combustion system would possess is that of an underbed air inlet means connected to the lower segment of the furnace volume and operative to properly fluidize the bubbling bed of hot solids by delivering upwardly mobile fluidizing air to the fluidized bed at a prescribed volumetric flow rate. By so controlling the volumetric flow rate of the fluidizing air, proper control may be had of the local stoichiometry of the combustion process, thus maintaining proper flue gas temperatures. Furthermore, such control of the volumetric flow rate of the fluidizing air helps prevent agglomeration of bed solids by mechanical agitation thereof.

Still further it is desirable that such a bubbling fluidized bed combustion system have an overbed air inlet means operative to deliver overbed air to the furnace volume to support the combustion of oil shale therein. By the judicious manipulation and control of such combustion supporting air and the upwardly flowing fluidizing air, proper control may then be had of the stoichiometric ratio of the combustion process in the furnace volume, thus controlling $NO_x$ emissions therefrom.

It is also desirable that such a new and improved bubbling fluidized bed combustion system possess an overbed fuel inlet means disposed in the lower segment of the furnace volume above the bubbling bed of hot solids and proximate in elevation with the overbed air inlet means. Said overbed fuel inlet means is operative to spread oil shale evenly over the bubbling bed of hot solids.

Still another desirable characteristic that such a new and improved bubbling fluidized bed combustion system would possess is that of an ash drainage means disposed in the lower segment of the furnace volume proximate in elevation with the bubbling bed of hot solids while yet further disposed opposite from the overbed fuel inlet means in the furnace volume.

Yet further, it is desirable that such a new and improved bubbling fluidized bed combustion system be capable of the combustion of oil shale therein and the generation of steam thereby without the need for incorporating in the fluidized bed combustion system a solids/gas separator.

Still further, it is desirable that such a new and improved bubbling fluidized bed combustion system have a backpass volume in fluid communication with the furnace volume and contain therein a plurality of economizer heat exchange means in fluid communication therebetween and integral to the thermodynamic steam cycle. It is also desirable that such a backpass volume contain an air preheater means for heating air prior to injection thereof into the furnace volume via the underbed air inlet means.

It is therefore an object of the present invention to provide a new and improved fluidized bed combustion system. To that end it is an object of the present invention to provide such a new and improved fluidized bed combustion system that is in the nature of a bubbling fluidized bed combustion system which is particularly well suited to effect therein the combustion of a highly reactive fuel having a high ash content, a low higher heating value (HHV), a high limestone ($CaCO_3$) content and having a tendency to foul convective heat transfer surfaces.

It is further an object of the present invention to provide such a new and improved fluidized bed combustion system, particularly well suited to effect therein the combustion of oil shale, so as to have a bubbling bed of hot solids disposed within the lower segment of the furnace volume. It is also an object of the present invention to provide such a bubbling bed of hot solids including therein a plurality of isolatable segments whereby such a bubbling bed of hot solids which is capable of being slumped, i.e., having one or more segments thereof isolated and made inoperative for the purpose of operating the bubbling fluidized bed combustion system so as to effectively respond to changing demands placed thereupon. Still further, it is an object of the present invention that such a bubbling bed of hot solids be capable of containing, in such a plurality of isolatable segments thereof, a plurality of heat exchange means for use either in a water-evaporative steam loop, or in a water-superheated steam loop in the thermodynamic steam cycle.

It is also an object of the present invention to provide such a new and improved fluidized bed combustion system, particularly well suited to effect therein the combustion of oil shale, so as to have a deentrainment zone disposed in the lower segment of the furnace volume and characterized by an increasing cross sectional area with increasing height within the furnace volume such that larger particulate matter, i.e., larger unburned fuel particles entrained within the upwardly mobile flue gases, fall out of the flue gases and are recirculated to the bubbling bed of hot solids for continued combustion.

Yet a further object of the present invention is to provide such a new and improved bubbling fluidized bed combustion system, particularly well suited to effect the combustion therein of oil shale, having freeboard heat exchange means disposed in the lower segment of the furnace volume above the deentrainment zone. It is an object of the present invention that such freeboard heat exchange means are capable of performing heat transfer duty either in a water-evaporative steam loop, or in a water-superheated steam loop in the thermodynamic steam cycle. Furthermore, it is an object of the present invention that such freeboard heat exchange means be disposed parallel to the flow of the upwardly mobile flue gases and operative to remove heat therefrom released thereinto due to the combustion of shale oil, providing effective control thereby of the temperature of the upwardly mobile flue gases in the furnace volume. Such control of the temperature of the upwardly mobile flue gases allows the fluidized bed combustion system to be operated at a lower flue gas temperature, thereby reducing the potential for the aforesaid fouling of convective heat exchange means that arises with the use of oil shale as a fuel.

Yet further, it is an object of the present invention to provide such a new and improved fluidized bed combustion system, particularly well suited to effect therein the combustion of oil shale, so as to have a fluidized bed ash cooler incorporated as an integral part thereof wherein the fluidized bed ash cooler acts as a heat exchanger. It is also an object of the present invention to provide such a fluidized bed ash cooler that is capable of accepting as input thereto relatively hot ash particles, originating from the bubbling bed of hot solids and resulting from the incomplete combustion of shale oil within the furnace volume. It is also an object of the present invention to provide such a fluidized bed ash cooler which is capable of accepting as fluid input thereto relatively cool air, for exchanging heat therein with the aforesaid relatively hot ash particles, prior to delivery therefrom to either the aforesaid bubbling bed of hot solids or to an overbed air inlet means disposed above the bubbling bed of hot solids in the lower segment of the furnace volume. It is also an object of the present invention to provide such a fluidized bed ash cooler so as to be capable of classifying finer ash particles from coarser ash particles and returning the finer ash particles either to the bubbling bed of hot solids while yet delivering the coarser ash particles to an ash discharge means. Still further it is an object of the present invention to provide such a fluidized bed ash cooler which is capable of performing heat transfer duty either in a water-evaporative steam loop, or in a water-superheated steam loop in the thermodynamic steam cycle. It is also an object of the present invention that such a fluidized bed ash cooler include therein a plurality of isolatable segments thereof. Yet further it is an object of the present invention to provide such a fluidized bed ash cooler that is capable of being slumped, i.e., having one or more segments thereof isolated and made inoperative for the purpose of operating the bubbling fluidized bed combustion system so as to effectively respond to changing demands placed thereupon while yet maintaining the aforesaid classification capability.

Yet further, it is an object of the present invention to provide such a new and improved fluidized bed combustion system, particularly well suited to effect therein the combustion of oil shale, so as to have a multi-chambered upper segment of the furnace volume;

each chamber therein being in fluid communication with the lower segment of the furnace volume. It is also an object of the present invention to provide such a multi-chambered upper segment of the furnace volume so as to comprise for example two chambers whereby a first chamber thereof contains a plurality of superheat heat exchange means in fluid communication therebetween and integral to the thermodynamic steam cycle and a second chamber thereof contains a plurality of reheat heat exchange means in fluid communication therebetween and integral to the thermodynamic steam cycle. Still further, it is an object of the present invention to provide such a multi-chambered upper segment of the furnace volume so as to have operatively connected thereto, means for controlling the distribution of the flow of the aforesaid upwardly mobile flue gases through the first and second chambers thereof and controlling thereby the reheated steam outlet (RHO) temperature of the thermodynamic steam cycle.

It is another object of the present invention to provide such a new and improved bubbling fluidized bed combustion system, particularly well suited to effect therein the combustion of oil shale, so as to have an underbed air inlet means connected to the lower segment of the furnace volume and operative to properly fluidize the bubbling bed of hot solids by delivering upwardly mobile fluidizing air to the fluidized bed at a prescribed volumetric flow rate.

It is another object of the present invention to provide such a new and improved bubbling fluidized bed combustion system, particularly well suited to effect therein the combustion of oil shale, so as to have an overbed air inlet means disposed in the lower segment of the furnace volume above the bubbling bed of hot solids and operative to control the stoichiometric ratio of the combustion process in the furnace volume; thus controlling $NO_x$ emissions therefrom.

It is also an object of the present invention that such a new and improved bubbling fluidized bed combustion system possess an overbed fuel inlet means disposed in the lower segment of the furnace volume above the bubbling bed of hot solids and operative to spread oil shale evenly over the bubbling bed of hot solids.

Still further it is an object of the present invention to provide such a new and improved bubbling fluidized bed combustion system, particularly well suited to effect therein the combustion of oil shale, having an ash drainage means disposed in the lower segment of the furnace volume proximate in elevation with the bubbling bed of hot solids yet disposed opposite from the overbed fuel inlet means.

It is also an object of the present invention to provide such a new and improved bubbling fluidized bed combustion system which is particularly well suited for effecting therein the combustion of oil shale without incorporating in the fluidized bed combustion system a solids/gas separator.

Furthermore, it is an object of the present invention to provide such a new and improved bubbling fluidized bed combustion system, particularly well suited to effect therein the combustion of oil shale, having a backpass volume in fluid communication with the furnace volume and containing a plurality of economizer heat exchange means in fluid communication therebetween and integral to the thermodynamic steam cycle. It is also an object of the present invention that such a backpass volume contain an air preheater means for heating air prior to injection thereof into the furnace volume via the underbed air inlet means.

SUMMARY OF THE INVENTION

Figure 1:
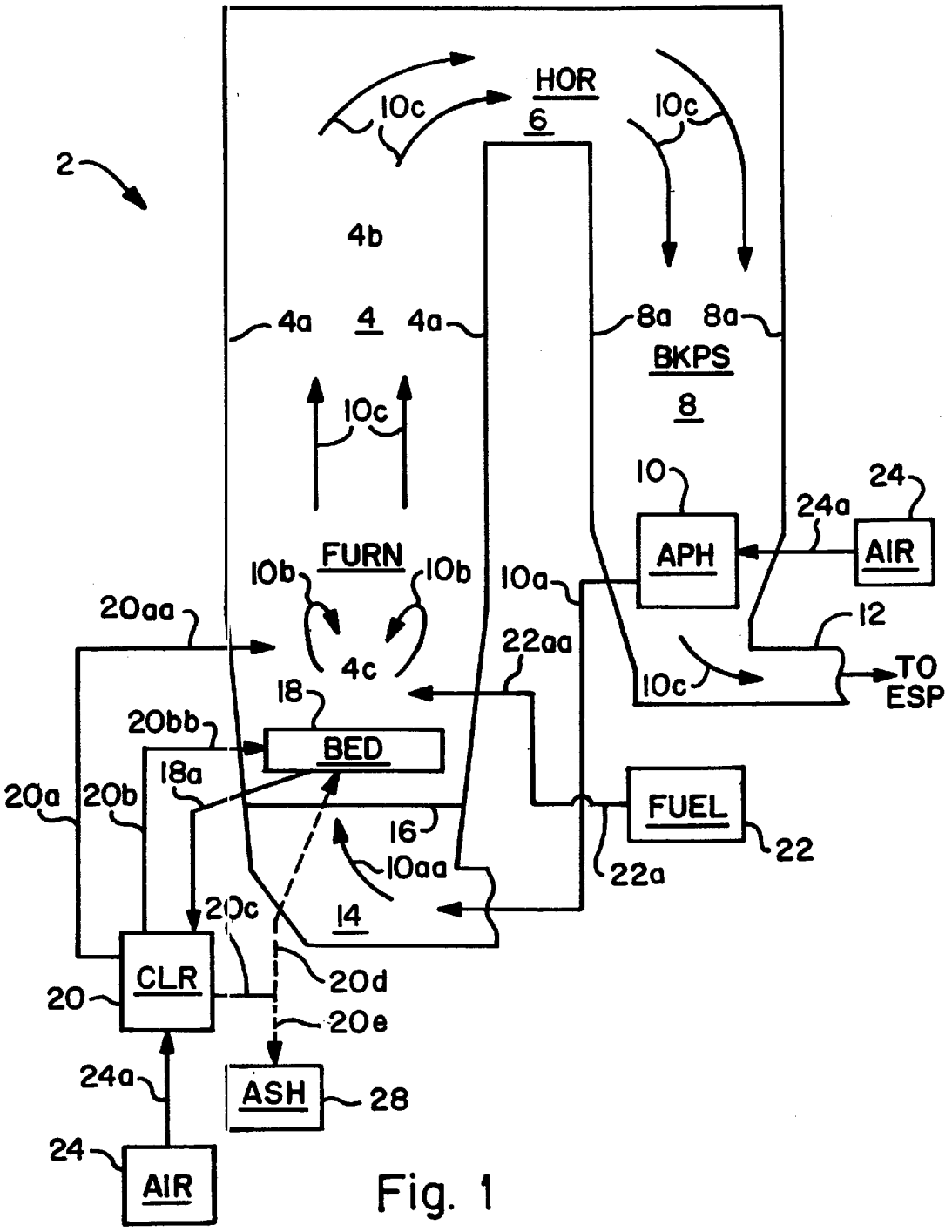
FIG. 1 is a generalized schematic representation of a side elevation of a bubbling fluidized bed combustion system generally including a furnace volume, horizontal pass, backpass volume, air preheater means, fluidized bed, underbed air inlet means, fuel supply means, air supply means, fluidized bed ash cooler and associated ductwork constructed in accordance with the present invention.

In accordance with one aspect of the present invention there is provided a bubbling fluidized bed combustion system having a thermodynamic steam cycle and a flue gas flow path acting in cooperative association therebetween for effecting the combustion of oil shale therein and the generation of steam thereby. The subject bubbling fluidized bed combustion system includes a furnace volume defined by a plurality of waterwall tubes and embodying therewithin a lower segment for the combustion of oil shale therein. Such combustion generates upwardly mobile flue gases. The furnace volume also includes a multi-chambered upper segment in fluid flow relation with the lower segment thereof, an underbed air inlet means connected to the lower segment of the furnace volume, and an air distribution means disposed within the lower segment of the furnace volume above the underbed air inlet means. The air distribution means is operative to distribute upwardly flowing fluidizing air evenly across the lower segment of the furnace volume. The furnace volume also includes a fluidized bed composed of bed solids disposed within the lower segment of the furnace volume above the air distribution means as well as means operatively connected to the multi-chambered upper segment of the furnace volume for controlling the distribution of the flow of the upwardly mobile flue gases through the multi-chambered upper segment of the furnace volume. Furthermore, the furnace volume includes overbed air inlet means connected to the lower segment thereof and disposed above the fluidized bed and fluidized bed air inlet means. The fluidized bed air inlet means is connected to the lower segment of the furnace volume and proximate in elevation to the fluidized bed. Yet further the furnace volume of the fluidized bed combustion system has a deentrainment zone disposed in the lower segment thereof and characterized by an increasing horizontal cross sectional area with increasing height in the furnace. Continuing, the furnace volume also includes a plurality of freeboard heat exchange means integral to the thermodynamic steam cycle and disposed in the lower segment thereof above the deentrainment zone. The fluidized bed combustion system includes a fluidized bed ash cooler operative as a heat exchanger which includes an air inlet means, an ash inlet means connected in fluid flow relationship with the fluidized bed, a plurality of air outlet means, an ash discharge means and a plurality of isolatable segments therein. The subject bubbling fluidized bed combustion system includes a backpass volume defined by a plurality of steam cooled backpass wall tubes integral to the thermodynamic steam cycle. Said backpass volume is connected in fluid flow relation with the furnace volume and includes means for preheating air which has operatively connected thereto a primary air inlet means and a fluidizing air outlet means in fluid flow relation with the underbed air inlet means.

The subject bubbling fluidized bed combustion system further includes a steam drum for separating steam from water, a plurality of circulatory fluid flow paths integral to the thermodynamic steam cycle and operative as a plurality of water-evaporative steam loops and a circulatory fluid flow path integral to the thermodynamic steam cycle and operative as a water-superheated steam loop. The subject bubbling fluidized bed combustion system also includes a feedwater supply means, means for conveying feedwater from the feedwater supply means to the steam drum, fuel supply means and a plurality of means for injecting oil shale from the fuel supply means into the lower segment of the furnace volume for combustion therein.

DESCRIPTION OF THE PREFERRED EMBODIMENT

Figure 1A:
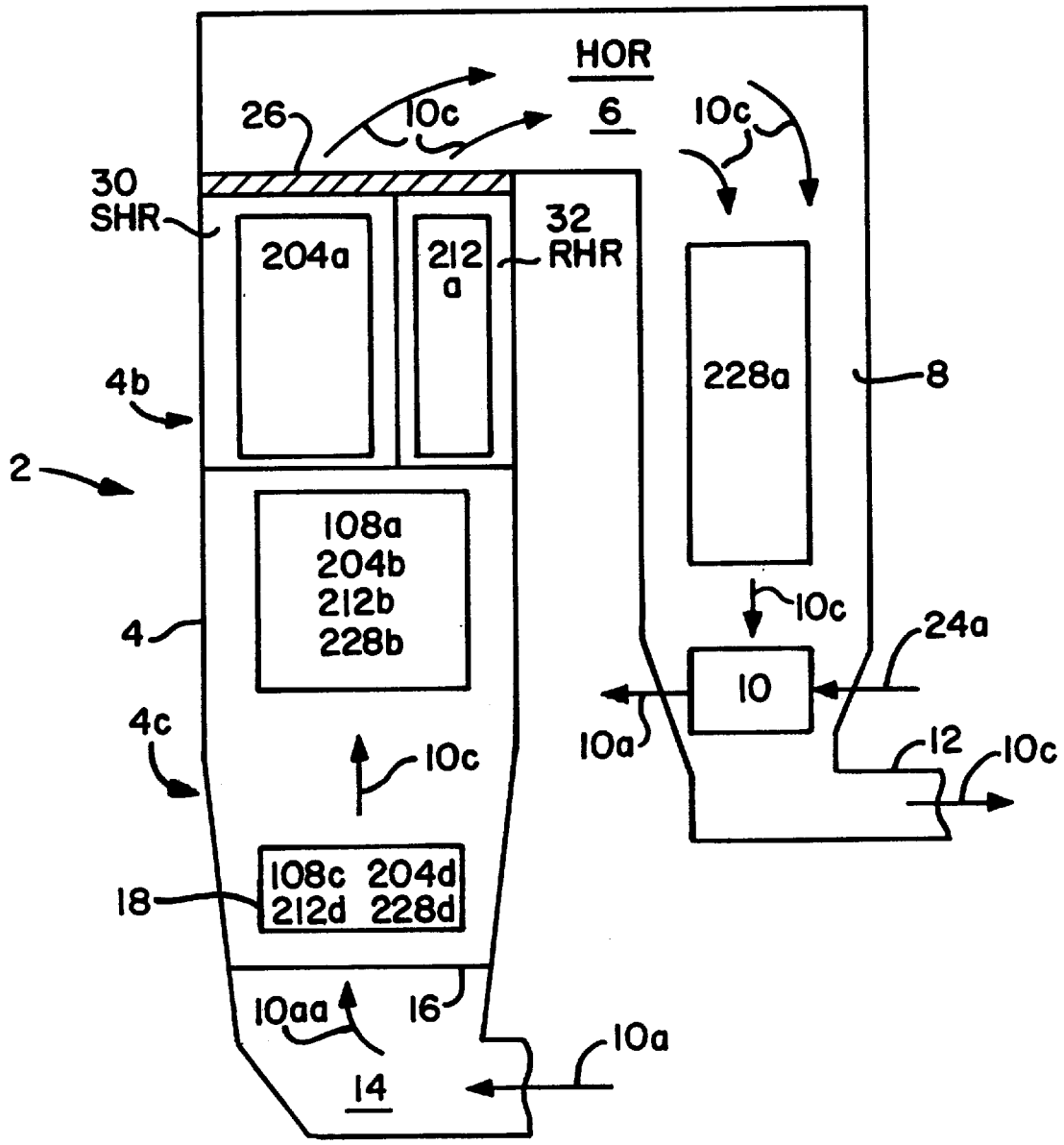
FIG. 1*a* is a further generalized schematic representation of a side elevation of the bubbling fluidized bed combustion system of FIG. 1 depicting the disposition of evaporative, superheat, reheat and economizer heat exchange means therein.

Referring now to the drawing, a description of the present invention will be made. In particular, depicted in FIGS. 1 and 1*a* of the drawing is a simplified schematic representation in the nature of a side elevation of a fluidized bed combustion system, generally designated by the reference numeral 2 and constructed in accordance with the present invention. As depicted in FIG. 1 the major components of the fluidized bed combustion system 2 of the present invention are a furnace volume (FURN) 4, a backpass volume (BKPS) 8 and a horizontal pass (HOR) 6 connecting the furnace volume 4 in fluid communication with the backpass volume 8. Continuing in FIG. 1 of the drawing, the furnace volume 4 is defined by a plurality of waterwall tubes 4*a*. Referring now to FIG. 1*a*, it can be seen that the furnace volume 4 is divided into a multi-chambered upper segment 4*b* thereof and a lower segment 4*c* thereof. As seen in FIGS. 1 and 1*a* there is attached to the lower segment 4*c* of the furnace volume 4 an underbed air inlet means 14 for delivering upwardly flowing fluidizing air 10*aa* thereto at a prescribed volumetric flow rate or velocity for the support of the combustion of oil shale therein. Furthermore, disposed in the lower segment 4*c* of the furnace volume 4 above the underbed air inlet means 14 there is an air distribution means 16 operative for distributing the upwardly flowing fluidizing air 10*aa* across the lower segment 4*c* of the furnace volume 4. Still further, there is disposed within the lower segment 4*c* of the furnace volume 4*a* fluidized bed 18 composed of bed solids.

Continuing with the description of the present invention, in FIG. 1 there is also depicted a fluidized bed ash cooler (CLR) 20 operative as a heat exchanger. The fluidized bed ash cooler 20 is so designed and constructed as to accept as input thereto relatively cool air 24*a* emanating from an air supply means 24 and in fluid communication therewith. Said fluidized bed ash cooler 20 is also designed and constructed so as to accept as input thereto relatively hot ash 18*a* emanating from the fluidized bed 18 and in fluid communication therewith. The fluidized bed ash cooler 20 also includes a plurality of air outlet means 20*a*, 20*b* operative to convey relatively hot overbed air 20*aa* and relatively hot fluidized bed air 20*bb* to the lower segment 4*c* of the furnace volume 4. Still further as shown in FIG. 1, the fluidized bed ash cooler 20 includes an ash discharge means 20*c* connected thereto and operative to convey by conventional means relatively cool ash therefrom to the fluidized bed 18 as designated by the reference numeral 20*d* or to an ash disposal means (ASH) 28.

Continuing further in the description of the present invention, FIG. 1 depicts fuel supply means (FUEL) 22 operative to convey oil shale 22*aa* as a fuel to the lower segment 4*c* of the furnace volume 4 via fuel inlet means 22*a* for combustion therein. FIG. 1 also depicts an air preheater means (APH) 10 disposed in the lower segment of the backpass volume 8 and operative to accept as input thereto relatively cool air 24*a* emanating from the air supply means 24 and in fluid communication therewith. The air preheater means 10 also includes fluidizing air outlet means 10*a* operative to convey the relatively hot fluidizing air 10*aa* to the underbed air inlet means 14. Also depicted in FIG. 1 is a duct means 12 for conveying flue gases 10*c* from the backpass volume 8 to further flue gas treatment means, e.g., an electrostatic precipitator (ESP) (not shown).

Having made a general description of the major components of the fluidized bed combustion system 2 and the interrelation therebetween, a description will now be had of the flue gas flow path thereof. With continuing reference to FIGS. 1 and 1*a*, in the lower segment 4*c* of the furnace volume 4, oil shale 22*aa*, and possibly sorbent combined therewith, is mixed with and burned in overbed air 20*aa*, fluidized bed air 20*bb* and the aforesaid fluidizing air 10*aa* flowing upward and over the fluidized bed 18 at the aforesaid prescribed volumetric flow rate. Such combustion produces hot combustion gases 10*c* which rise within the furnace volume 4. As the hot combustion gases 10*c*, more commonly referred to as flue gases 10*c*, rise within the furnace volume 4, heat is transferred therefrom to the waterwall tubes 4*a*, integral to the thermodynamic steam cycle, causing steam to be evaporatively produced from water rising therein. Details of the thermodynamic steam cycle as depicted in FIGS. 3, 3*a*, 4 and 4*a* will be more fully described herein below and as needed in reference to the description of the flue gas flow path.

Reference will now be had to FIG. 5. FIG. 5 is a graphical representation of the functional dependency of the flue gas 10*c* temperature upon the stoichiometric ratio of the combustion process. It will be understood that by the judicious manipulation and control of the distribution in the relative volumetric flow rates of the upwardly flowing fluidizing air 10*aa* and the overbed air 20*aa*, the stoichiometric ratio of the combustion process can be controlled. As seen in FIG. 5, by so controlling the stoichiometric ratio the temperature of the flue gas can in turn be controlled. By so controlling the flue gas temperature the aforesaid fouling of convective heat transfer surfaces may be reduced, the proper balance may be had between calcination and boiler efficiency and $NO_x$ emissions from the bubbling fluidized bed combustion system 2 may be reduced.

Continuing with the description of the flue gas flow path of the present invention, as best understood from FIG. 1*a*, depending upon the needs of the thermodynamic steam cycle, the upper segment 4*b* of the furnace volume 4 may be divided into multiple chambers (SHR) 30, (RHR) 32. Each of the chambers 30, 32 of the multi-chambered upper segment 4*b* of the furnace volume 4 is separately in fluid communication with the lower segment 4*c* of the furnace volume 4. Control of the distribution of the flow of the upwardly mobile flue gases 10*c* therethrough is effected by a damper 26 operatively connected to the aforesaid multiple chambers 30, 32. By the judicious manipulation and control of the distribution thereof the reheated steam outlet (RHO) temperature may be controlled thereby. Said multiple chambers 30, 32 contain a plurality of heat exchange means 204*a*, 212*a*, integral to the thermodynamic steam cycle, for the purpose of superheating and reheating (i.e., further superheating) steam generated in the thermodynamic steam cycle. Also, depending upon the needs of the thermodynamic steam cycle, a plurality of freeboard heat exchange means 108*a*, 204*b*, 212*b*, 228*b*, integral to the thermodynamic steam cycle, is located in the lower segment 4*c* of the furnace volume 4 whereby the aforesaid flue gases 10*c*, rising within the furnace volume 4, transfer heat thereto for the purpose of evaporative generation of steam, economizer duty, superheating of steam or reheating of steam in the thermodynamic steam cycle. Such a utilization of said plurality of freeboard heat exchange means 108*a*, 204*b*, 212*b*, 228*b* aids in the effective control of the flue gas temperature.

From the top of the furnace volume 4, the flue gases 10*c* still contain useful energy and are directed, via the horizontal pass 6, to the backpass volume 8 wherein a plurality of economizer heat exchange means 228*a*, integral to the thermodynamic steam cycle, are located. The flue gases 10*c* are then made to flow through the backpass volume 8 wherein they are cooled as a consequence of an exchange of heat that takes place between the still relatively hot flue gases 10*c* and the relatively cool aforesaid economizer heat exchange means 228*a*. Upon exiting the backpass volume 8 the now cooler flue gases 10*c* are commonly made to flow to the air preheater means 10 whereat primary air 24*a* is heated prior to delivery as fluidizing air 10*aa* to the underbed air inlet means 14. Thereafter, the now cooler flue gases 10*c* are commonly made to flow, in known fashion, to and through a flue gas cleaning apparatus, e.g., an electrostatic precipitator (ESP) (not shown), via a duct 12 and are thence emitted to the atmosphere via a stack (not shown).

Figure 2:
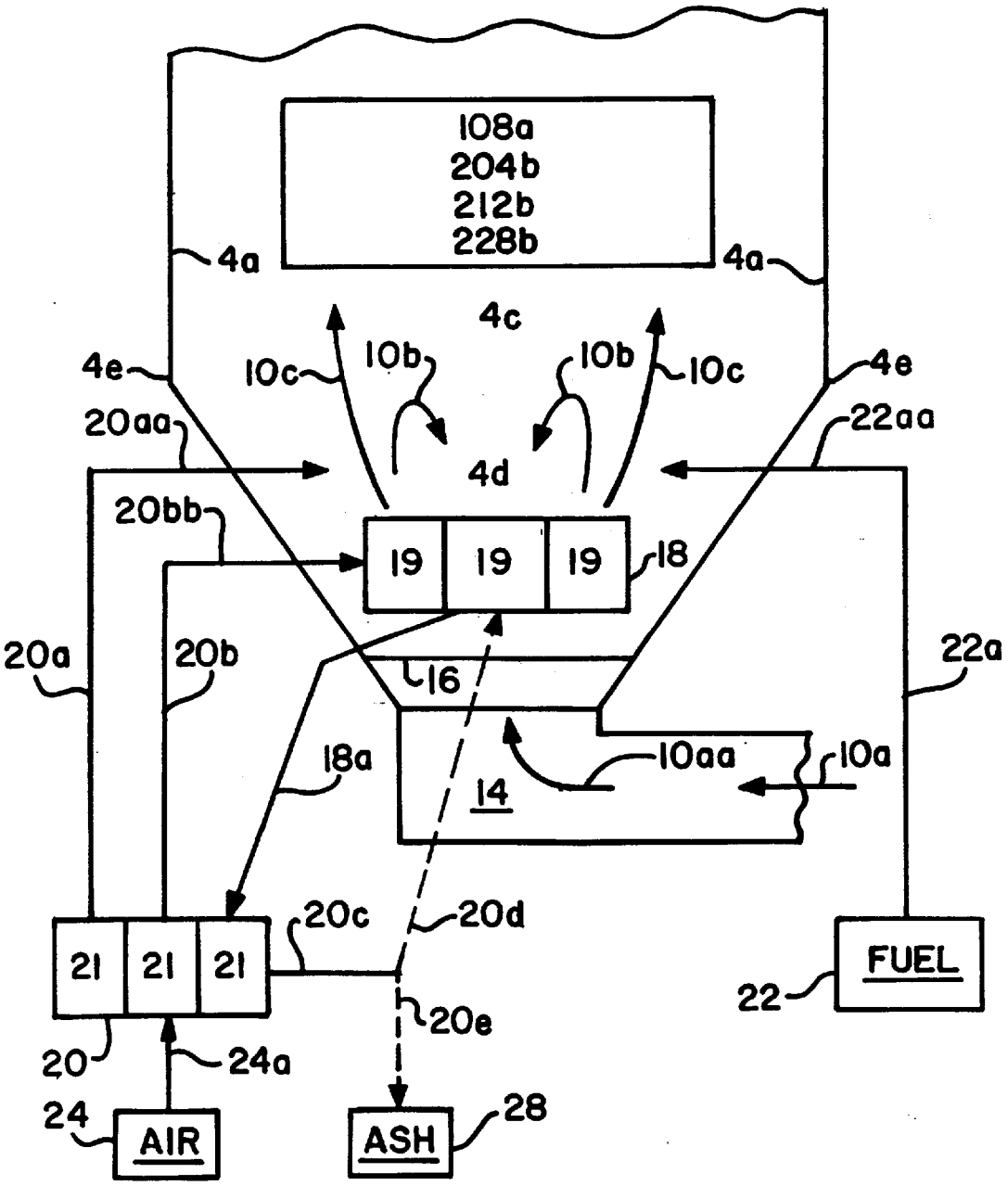
FIG. 2 is a more detailed schematic representation of the lower segment of the furnace volume of FIG. 1.

It is in the lower segment 4*c* of the furnace volume 4 that the combustion of oil shale 22*aa* is accomplished. In the interest of greater clarity and detail in the description of such combustion and the manner in which it relates to the present invention, reference is now made to FIG. 2. FIG. 2 is, by way of exemplification and not limitation, a more detailed, yet still simplified, schematic rendition of the lower segment 4*c* of the furnace volume 4 and appurtenances thereto, including the underbed air inlet means 14, the air distribution means 16, the fluidized bed 18, the fluidized bed ash cooler 20, the fuel supply means 22, the air supply means 24, the ash discharge means 28, the freeboard heat exchange means 108*a*, 204*b*, 212*b*, 228*b* and connections thereamongst.

Figure 2A:
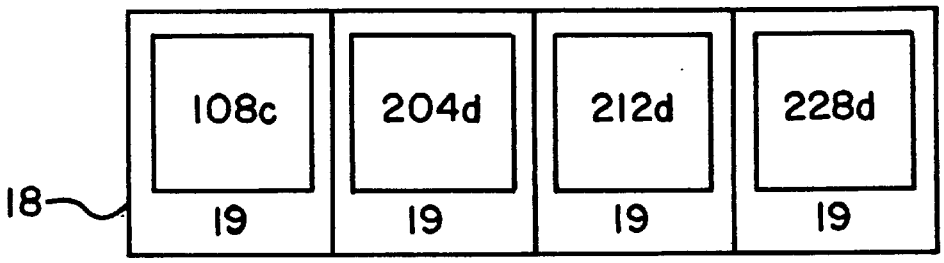
FIG. 2*a* is a more detailed schematic representation of the fluidized bed depicting the disposition of evaporative, superheat, reheat and economizer heat exchange means therein.

With specific regard to the fluidized bed 18, as best understood from FIGS. 2 and 2*a*, said fluidized bed 18 is in the nature of a bubbling fluidized bed of hot solids disposed within the lower segment 4*c* of the furnace volume 4. Such a bubbling fluidized bed 18 of hot solids is made possible by the judicious manipulation and control of the volumetric flow rate of the fluidizing air 10*aa* as the fluidizing air 10*aa* passes upward and over the bubbling fluidized bed 18 of hot solids at a prescribed volumetric flow rate. Furthermore, the bubbling fluidized bed 18 of hot solids includes a plurality of isolatable segments 19 thereof. Such a plurality of isolatable segments 19 allows the bubbling fluidized bed 18 of hot solids to be slumped, i.e., to have one or more segments 19 thereof isolated and made inoperative for the purpose of operating the fluidized bed combustion system 2 so as to effectively respond to changing demands placed thereupon. Still further, with reference to FIG. 2*a*, the bubbling fluidized bed 18 of hot solids is characterized in that, within such a plurality of isolatable segments 19 thereof, a plurality of heat exchange means 108*c*, 204*d*, 212*d*, 228*d*, integral to the thermodynamic steam cycle, may be disposed for use either in the water-evaporative steam loop 100, or in the water-superheated steam loop 200 of the thermodynamic steam cycle depicted in FIG. 3. By so incorporating such heat exchange means 108*c*, 204*d*, 212*d*, 228*d* of the thermodynamic steam cycle in the isolatable segments 19 of the bubbling fluidized bed 18 of hot solids, the temperature of the upwardly mobile flue gas stream 10*c* in the furnace volume 4 may be effectively controlled; thereby allowing the fluidized bed combustion system 2 to be operated at a lower flue gas temperature, thus reducing fouling of convective heat transfer surfaces common in the use of oil shale as a fuel.

Figure 2B:
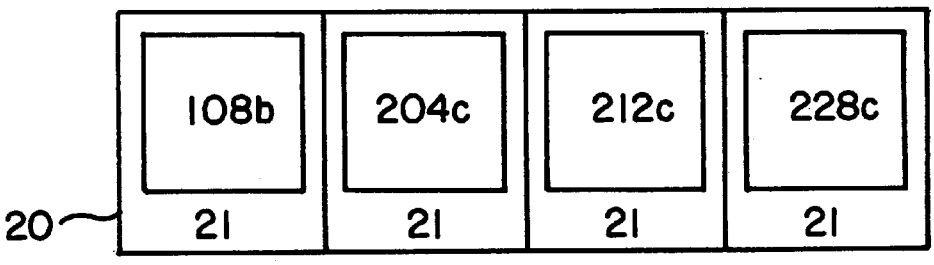
FIG. 2*b* is a more detailed schematic representation of the fluidized bed ash cooler depicting the disposition of evaporative, superheat, reheat and economizer heat exchange means therein.

With specific regard to the fluidized bed ash cooler 20, as best understood from FIGS. 2 and 2*b*, said fluidized bed ash cooler 20 is incorporated as an integral part of the fluidized bed combustion system 2 and acts as a heat exchanger thereof. To that end, the fluidized bed ash cooler 20 is so designed and constructed as to accept as input thereto both relatively cool air 24*a*, emanating from an air supply means 24, and relatively hot ash 18*a* emanating from the bubbling fluidized bed 18 of hot solids and resulting from the incomplete combustion of oil shale 22*aa* in the furnace volume 4. As a result of an exchange of heat therebetween and therein the relatively cool air 24*a* is heated and thence conveyed both as overbed air 20*aa* to a location above the bubbling fluidized bed 18 of hot solids to support the aforesaid combustion, and as fluidized bed air 20*bb* directly to the bubbling fluidized bed 18 of hot solids. Such an exchange of heat between the relatively cool air 24*a* and the relatively hot ash 18*a* recovers still useful energy from the relatively hot ash 18*a* for further use in the flue gas flow path and thermodynamic steam cycle, thus improving the efficiency of the fluidized bed combustion system 2. Furthermore, the nature of the fluidized bed ash cooler 20 is such that it is capable of classifying finer ash particles from coarser ash particles and returning the finer ash particles directly to the bubbling fluidized bed 18 of hot solids as designated by the reference numeral 20*d* in FIG. 2, while yet delivering the coarser ash particles to an ash discharge means 28.

Furthermore, with reference to FIG. 2*b*, the fluidized bed ash cooler 20 is comprised of a plurality of isolatable segments 21 thereof. Such a plurality of isolatable segments 21 allows the fluidized bed 20 ash cooler to be slumped, i.e., to have one or more segments 21 thereof isolated and made inoperative for the purpose of operating the fluidized bed combustion system 2 so as to effectively respond to changing demands placed thereupon while yet maintaining the aforesaid classification capabilities. Still further, the fluidized bed 20 ash cooler is characterized in that, within such a plurality of isolatable segments 21 thereof, a plurality of heat exchange means 108*b*, 204*c*, 212*c*, 228*c*, integral to the thermodynamic steam cycle, are disposed for use either in the water-evaporative steam loops 100, or in the water-superheated steam loop 200 of the thermodynamic steam cycle depicted in FIG. 3.

As best understood from FIG. 1 and FIG. 2, a flow path 18, 18*a*, 20, 20*c*, 20*d*, 18 may be established between the fluidized bed 18 and the fluidized bed ash cooler 20 for circulating relatively hot ash from the fluidized bed 18 to the fluidized be ash cooler 20 and relatively cool ash from the fluidized bed ash cooler 20 to the fluidized bed 18. However, the relatively cool ash may be simply discarded to an ash discharge means 28 as shown by the path designated by the reference numerals 20*c* and 20*e*.

FIG. 2 also depicts, by way of exemplification and not limitation, a deentrainment zone 4*d*. Said deentrainment zone 4*d* spans the vertical extent of the lower segment 4*c* of the furnace volume 4 from approximately the elevation of the air distribution means 16 to approximately the elevation noted by the reference numeral 4*e* in FIG. 2. The deentrainment zone 4*d* is characterized by an increasing horizontal cross sectional area with increasing height within the furnace volume 4. As a result of such increasing cross sectional area heavier particulate matter, i.e., heavier unburned oil shale particles 10*b*, entrained within the flue gas stream 10*c* fall out of the flue gas stream 10*c* toward the bubbling fluidized bed 18 of hot solids for further combustion. Such deentrainment increases the residence time of a particle of oil shale 22*aa*, thereby providing for a greater likelihood of combustion thereof and reducing the amount of unburned oil shale carried away in the flue gases 10*c*. By so reducing the amount of unburned oil shale carried away in the flue gas stream 10*c* the need for a solids/gas separator is eliminated and in addition the amount of sulfur capture and carbon burnout are increased.

FIG. 2 also depicts, by way of exemplification and not limitation, the plurality of freeboard heat exchange means 108*a*, 204*b*, 212*b*, 228*b* disposed in the lower segment 4*c* of the furnace volume 4 above the deentrainment zone 4*d*. Such freeboard heat exchange means 108*a*, 204*b*, 212*b*, 228*b* are capable of heat transfer duty either in the water-evaporative steam loops 100, or in the water-superheated steam loop 200 in the thermodynamic steam cycle depicted in FIG. 3. Furthermore, such freeboard heat exchange means 108*a*, 204*a*, 212*a*, 228*b* are disposed parallel to the flow of the upwardly mobile flue gases 10*c* and act to remove heat therein released thereto due to the combustion of oil shale 22*aa* in the furnace volume 4. The plurality of freeboard heat exchange means 108*a*, 204*b*, 212*b*, 228*b* also provides effective control of the temperature of the upwardly mobile flue gases 10*c* in the furnace volume 4 so as to allow the fluidized bed combustion system 2 to be operated at lower flue gas temperatures, thus reducing the potential for fouling of convective heat exchange means which is typical when using oil shale as fuel in fluidized bed combustion systems and improving calcination.

Figure 3:
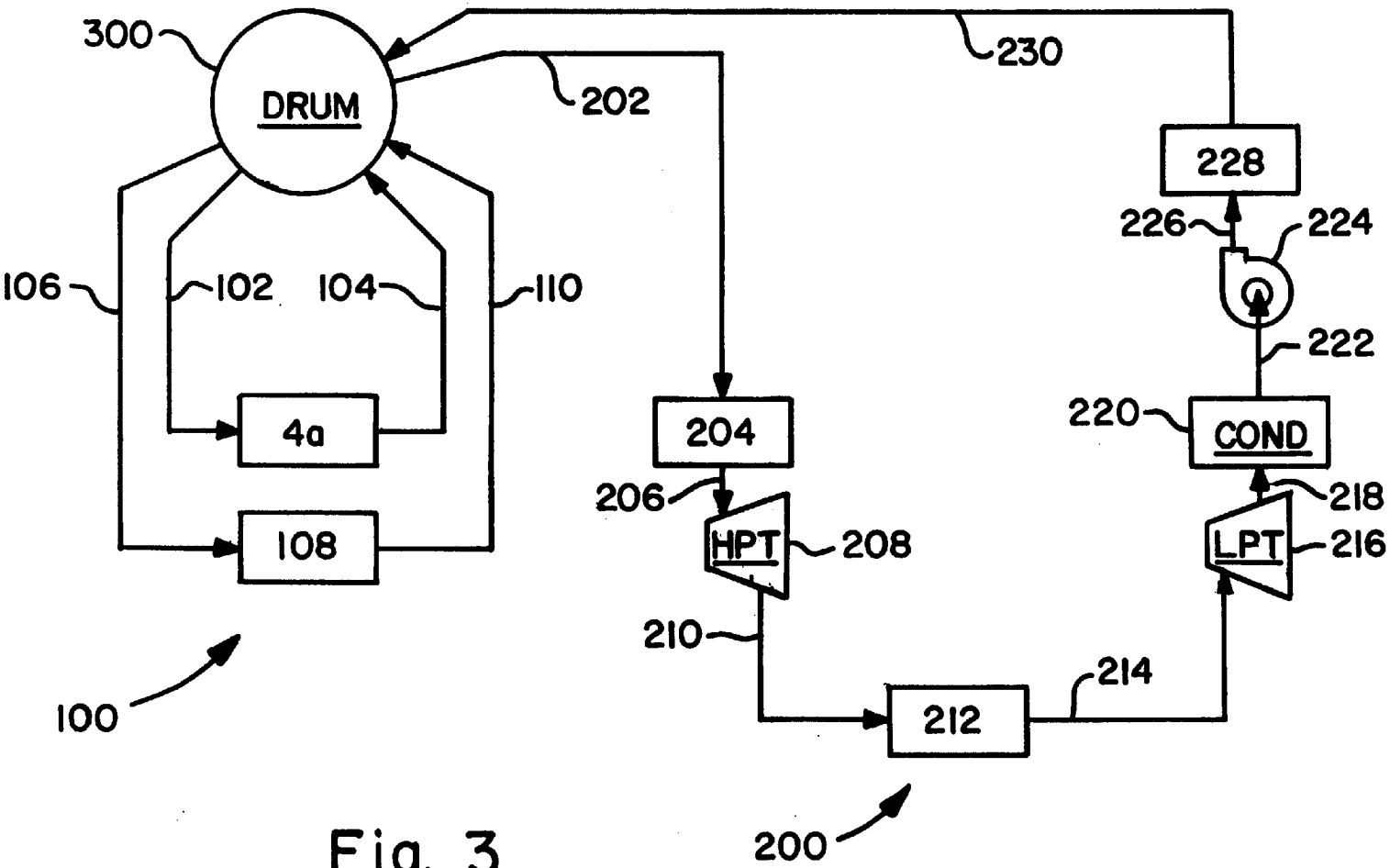
FIG. 3 is a simplified schematic representation of the fluid circuitry of a first embodiment of a thermodynamic steam cycle employable with a bubbling fluidized bed combustion system such as the bubbling fluidized bed combustion system depicted in FIG. 1.
Figure 4:
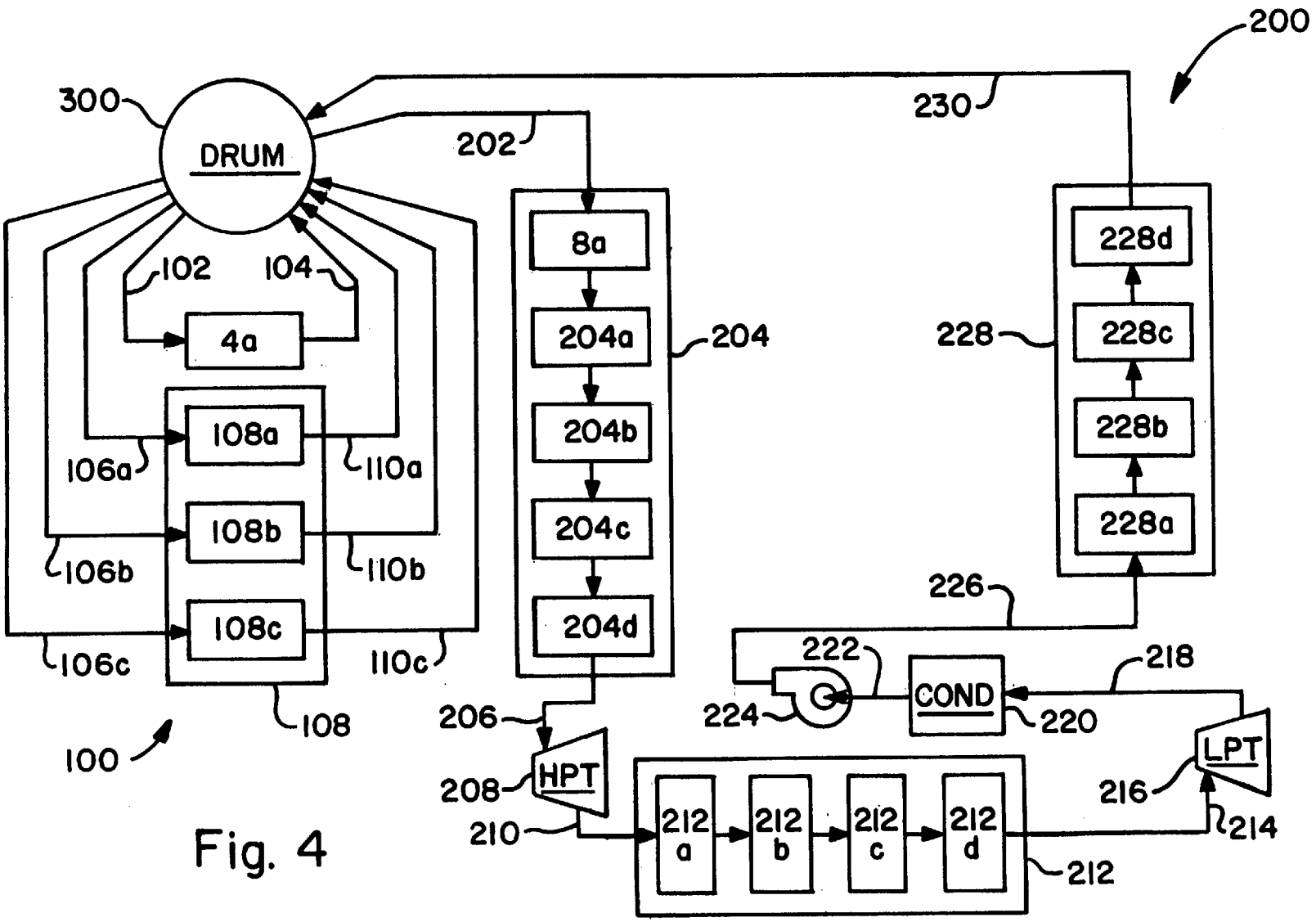
FIG. 4 is a simplified schematic representation in greater detail of the fluid circuitry of the first embodiment of a thermodynamic steam cycle depicted in FIG. 3 and employable with a bubbling fluidized bed combustion system such as the bubbling fluidized bed combustion system depicted in FIG. 1.
Figure 4A:
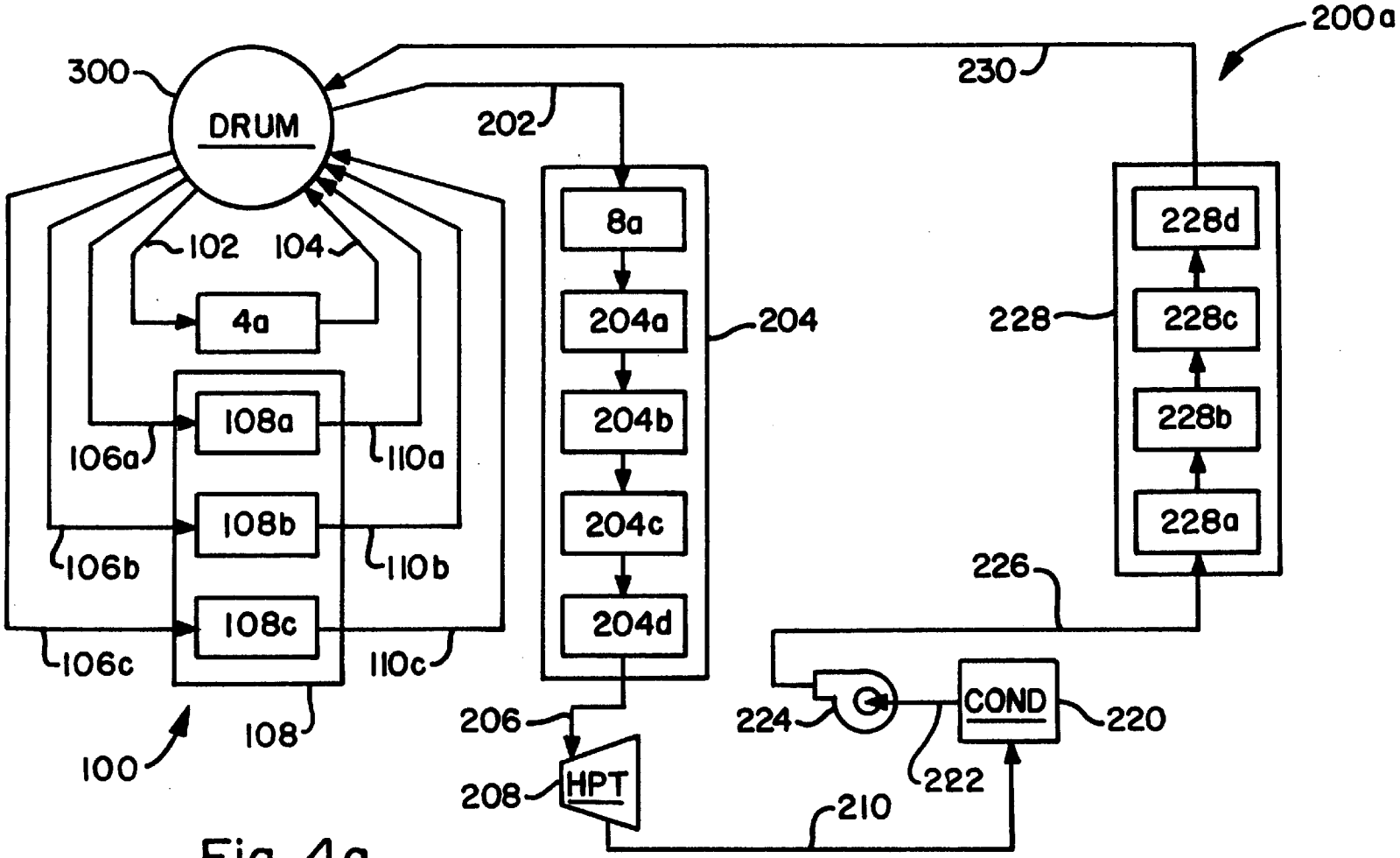
FIG. 4*a* is a simplified schematic representation in greater detail of the fluid circuitry of the second embodiment of the thermodynamic steam cycle depicted in FIG. 3*a* and employable with a bubbling fluidized bed combustion system such as the bubbling fluidized bed combustion system depicted in FIG. 1.

With specific regard to the aforesaid thermodynamic steam cycle and the manner in which it relates to the present invention, reference is now had to FIGS. 3 through 4*a*, inclusive, of the drawing. It should be understood from FIGS. 3 through 4*a* that the fluid circuitry of the aforesaid thermodynamic steam cycle includes, although they may not be shown, a multiplicity of downcomers, risers, tubes, headers, piping links, valves and flow or temperature control devices known to those skilled in the art to assist in effecting the flow of water and steam therethrough in accordance with the needs thereof. In accordance with the teachings of the present invention, FIG. 3 depicts, by way of exemplification and not limitation, a simplified schematic representation of the fluid circuitry of the thermodynamic steam cycle as it is generally comprised of a plurality of circulatory fluid flow paths operative as a plurality of water-evaporative steam loops 100, a circulatory fluid flow path operative as a water-superheated steam loop 200 and a stream drum 300. As can be seen from FIG. 3 the fluid circuitry of the plurality of water-evaporative steam loops 100 and the water-superheated steam loop 200 are in fluid communication by way of the steam drum 300. Continuing in FIG. 3 it will be seen that the plurality of water-evaporative steam loops 100 is comprised of a first water-evaporative steam loop including the waterwall tubes 4*a*, means 102 for conveying water from the steam drum 300 thereto and means 104 for conveying a mixture of water and steam therefrom to the steam drum 300. As best understood from FIG. 3 the aforesaid plurality of water-evaporative steam loops 100 includes a further plurality of water-evaporative steam loops comprising a plurality of evaporative heat exchange means 108, a plurality of means 106 for conveying water from the steam drum 300 thereto, and a plurality of means 110 for conveying a mixture of water and steam therefrom to the steam drum 300.

The operative nature of a water-evaporative steam loop is such that the steam drum 300 contains a mixture of water and steam wherein the steam is separated from the water by known means. The water is thence conveyed, by conventional means 102, 106, from the steam drum 300 to the heat exchange means 4*a*, 108 wherein steam is evaporatively generated from the water therein as a consequence of the exchange of heat that takes place between the water and a heat source (i.e., hot flue gases 10*c*, hot ash 18*a*, bubbling fluidized bed of hot solids 18). A mixture of water and steam is then conveyed, by conventional means 104, 110, from the heat exchange means 4*a*, 108 to the steam drum 300 wherein the mixture again undergoes the aforesaid separation after which the water is again conveyed to the heat exchange means 4*a*, 108 to continue the process of the evaporative generation of steam.

Continuing with reference to FIG. 3, the water-superheated steam loop 200 is comprised of at least one superheat heat exchange means 204, means 202 for conveying steam from the steam drum 300 thereto, a high pressure turbine 208, means 206 for conveying steam from the at least one superheat heat exchange means 204 thereto, at least one reheat heat exchange means 212, means 210 for conveying steam from the high pressure turbine 208 thereto, a low pressure turbine 216, means 214 for conveying steam from the at least one reheat heat exchange means 212 thereto, a condenser 220, means 218 for conveying steam from the low pressure turbine thereto 216, fluid conveying means 224, means 222 for conveying steam from the condenser 220 thereto, at least one economizer heat exchange means 228, means 226 for conveying steam from the fluid conveying means 224 thereto and means 230 for conveying steam from the at least one economizer heat exchange means 228 to the steam drum 300.

A brief explanation of the water-superheated steam loop 200 of FIG. 3 will now be had. To that end, as noted above, the steam drum 300 contains a mixture of water and steam wherein the steam is separated from the water by known means. Said steam is conveyed by conventional means 202 from the steam drum 300 to the at least one superheat heat exchange means 204 wherein the steam undergoes a first superheating. From the at least one superheat heat exchange means 204 the steam is conveyed by conventional means 206 to the high pressure turbine 208 for expansion therein. After expansion in the high pressure turbine 208 the still superheated steam is made to flow therefrom by conventional means 210 to the at least one reheat heat exchange means 212 wherein the steam is reheated, i.e., further superheated. From the at least one reheat heat exchange means 212 the reheated steam is then conveyed by conventional means 214 to the low pressure turbine 216 for expansion therein. After expansion in the low pressure turbine 216 the still superheated steam is then made to flow therefrom by conventional means 218 to the condenser 220 wherein the steam is condensed to water. From the condenser 220 the water is made to flow, under the motive power of the fluid conveying means 224 to the at least one economizer heat exchange means 228 wherein the water is heated. From the at least one economizer heat exchange means 228 the heated water is then made to flow by conventional means 230 to the steam drum 300 for further use in the thermodynamic steam cycle.

Figure 3A:
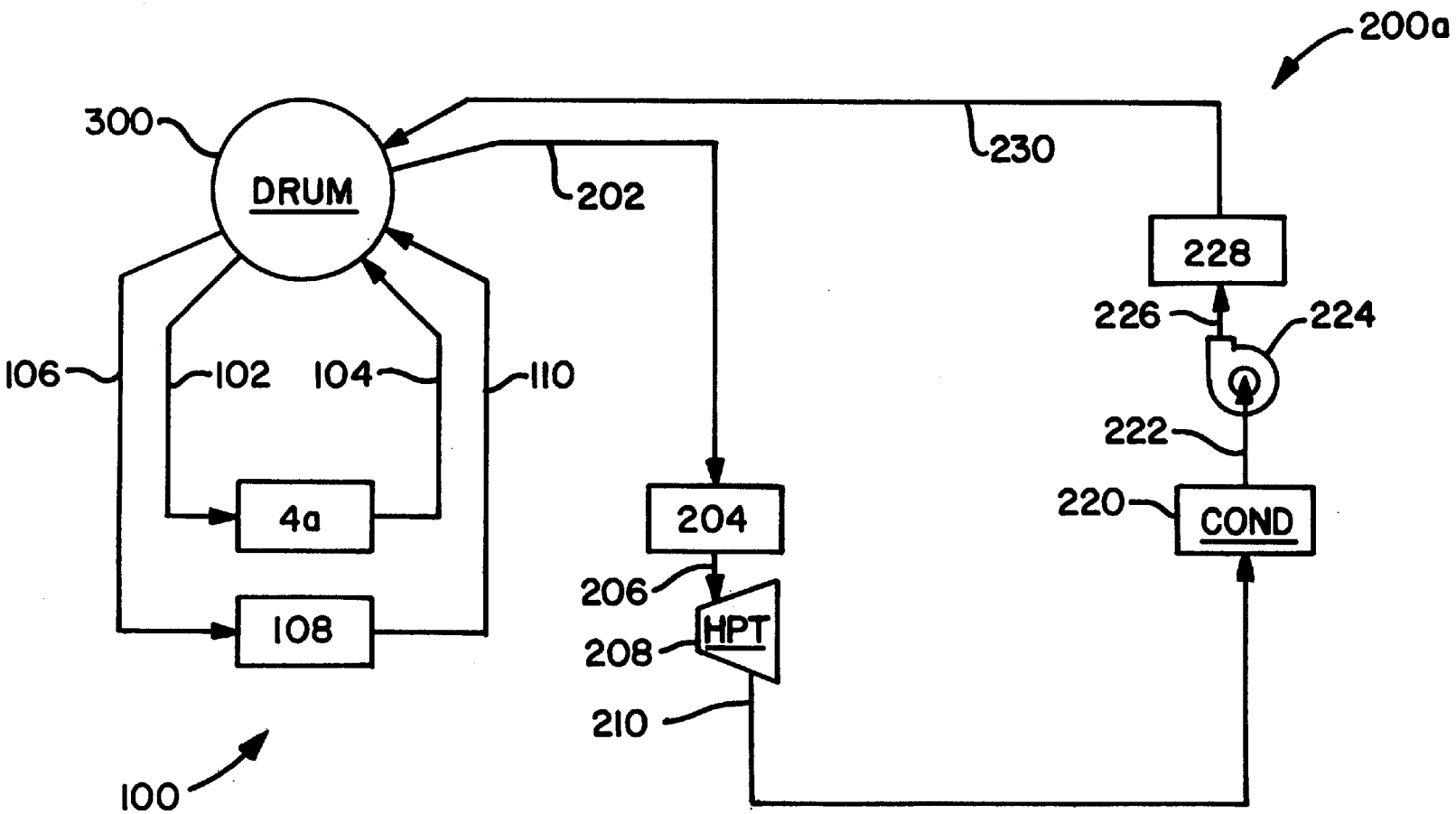
FIG. 3*a* is a simplified schematic representation of the fluid circuitry of a second embodiment of a thermodynamic steam cycle employable with a bubbling fluidized bed combustion system such as the bubbling fluidized bed combustion system depicted in FIG. 1.

Reference is momentarily made to FIG. 3*a*, wherein it is seen that a water-superheated steam loop 200*a* may also be accomplished without the use of a reheat segment i.e., by eliminating the reheat heat exchange means 212 and the low pressure turbine 216 and conveying steam from the high pressure turbine 208 directly to the condenser 220.

Reference is now made to FIG. 4 of the drawing wherein depicted is a more detailed schematic diagram of the plurality of water-evaporative steam loops 100 and the water-superheated steam loop 200 depicted in FIG. 3.

As can be seen in FIG. 4, the plurality of evaporative heat exchange means 108 of FIG. 3 includes a plurality of evaporative heat exchange means designated by the reference numerals 108*a*, 108*b*, 108*c*. Likewise, the plurality of means 106 of FIG. 3 for conveying water from the steam drum 300 to the plurality of evaporative heat exchange means 108, includes a plurality of means 106*a*, 106*b*, 106*c* for conveying water from the steam drum 300 to the plurality of evaporative heat exchange means 108*a*, 108*b*, 108*c*. Again likewise, the plurality of means 110 of FIG. 3 for conveying water from the plurality of evaporative heat exchange means 108 to the steam drum 300, includes a plurality of means 110*a*, 110*b*, 110*c* for conveying water from the plurality of evaporative heat exchange means 108*a*, 108*b*, 108*c* to the steam drum 300.

As best understood from FIG. 4, and in accordance with the teachings of the present invention, the plurality of evaporative heat exchange means 108*a*, 108*b*, 108*c* includes three evaporative heat exchange means wherein a first evaporative heat exchange means 108*a* thereof is a first heat exchange means of the plurality of freeboard heat exchange means 108*a*, 204*b*, 212*b*, 228*b* and a second evaporative heat exchange means 108*b* thereof is disposed in a first isolatable section 21 of the plurality of isolatable sections 21 of the fluidized bed ash cooler 20 and a third evaporative heat exchange means 108*c* thereof is disposed in a first isolatable section 19 of the plurality of isolatable sections 19 of the fluidized bed 18.

With further reference to FIG. 4 it can be seen that the at least one superheat heat exchange means 204 of FIG. 3 includes a plurality of superheat heat exchange means in fluid communication therebetween as designated by the reference numerals 8*a*, 204*a*, 204*b*, 204*c*, 204*d*. As best understood from FIG. 4, and in accordance with the teachings of the present invention, the plurality of superheat heat exchange means 8*a*, 204*a*, 204*b*, 204*c*, 204*d* includes five superheat heat exchange means in fluid communication therebetween wherein a first superheat heat exchange means 8*a* thereof is the steam cooled backpass wall tubes 8*a* and a second superheat heat exchange means 204*a* thereof is disposed in the first chamber 30 of the multi-chambered upper segment 4*b* of the furnace volume 4 and a third superheat heat exchange means 204*b* thereof is a second heat exchange means of the plurality of freeboard heat exchange means 108*a*, 204*b*, 212*b*, 228*b* and a fourth superheat heat exchange means 204*c* thereof is disposed in a first isolatable segment 21 of the fluidized bed ash cooler 20 and a fifth superheat heat exchange means 204*d* thereof is disposed in a first isolatable segment 19 of the fluidized bed 18.

With further reference to FIG. 4 it can be seen that the at least one reheat heat exchange means 212 of FIG. 3 includes a plurality of reheat heat exchange means in fluid communication therebetween as designated by the reference numerals 212*a*, 212*b*, 212*c*, 212*d*. As best understood from FIG. 4, and in accordance with the teachings of the present invention, the plurality of reheat heat exchange means 212*a*, 212*b*, 212*c*, 212*d* includes four reheat heat exchange means in fluid communication therebetween wherein a first reheat heat exchange means 212*a* thereof is disposed in the second chamber 32 of the multi-chambered upper segment 4*b* of the furnace volume 4 and a second reheat heat exchange means 212*b* thereof is a third heat exchange means of the plurality of freeboard heat exchange means 108*a*, 204*b*, 212*b*, 228*b* and a third reheat heat exchange means 212*c* thereof is disposed in a first isolatable segment 21 of the fluidized bed ash cooler 20 and a fourth reheat heat exchange means 212*d* thereof is disposed in a first isolatable segment 19 of the fluidized bed 18.

With further reference to FIG. 4 it can be seen that the at least one economizer heat exchange means 228 of FIG. 3 comprises a plurality of economizer heat exchange means in fluid communication therebetween as designated by the reference numerals 228*a*, 228*b*, 228*c*, 228*d*. As best understood from FIG. 4, and in accordance with the teachings of the present invention, the plurality of economizer heat exchange means 228*a*, 228*b*, 228*c*, 228*d* includes four economizer heat exchange means in fluid communication therebetween wherein a first economizer heat exchange means 228*a* thereof is disposed in the backpass volume 8 and a second economizer heat exchange means 228*b* thereof is a fourth heat exchange means of the plurality of freeboard heat exchange means 108*a*, 204*b*, 212*b*, 228*b* and a third economizer heat exchange means 228*c* thereof is disposed in a first isolatable segment 21 of the fluidized bed ash cooler 20 and a fourth economizer heat exchange means 228*d* thereof is disposed in a first isolatable segment 19 of the fluidized bed 18.

Reference is momentarily made to FIG. 4*a*, wherein depicted is a more detailed schematic representation of the water-superheated steam loop 200*a* of FIG. 3*a* wherein the reheat segment i.e., the reheat heat exchange means 212*a*, 212*b*, 212*c*, 212*d* and the low pressure turbine 216 are eliminated, and steam is conveyed from the high pressure turbine 208 directly to the condenser 220.

It should therefore be obvious from the foregoing description of the present invention that there has been provided a new and improved fluidized bed combustion system.

More specifically, there has been provided a new and improved fluidized bed combustion system in the nature of a bubbling fluidized bed combustion system capable of effecting therein the combustion of a highly reactive fuel having a high ash content, a low higher heating value (HHV), a high limestone ($CaCO_3$) content and having a tendency to foul convective heat transfer surfaces.

Moreover, there has been provided such a new and improved bubbling fluidized bed combustion system possessing a bubbling bed of hot solids disposed within the lower segment of the furnace volume including therein a plurality of isolatable segments thereof and capable of being slumped, i.e., capable of having one or more of said segments thereof isolated and made inoperative for the purpose of operating the bubbling fluidized bed combustion system so as to effectively respond to changing demands placed thereupon. Still further, there has been provided such a bubbling bed of hot solids capable of containing, in such a plurality of isolatable segments, a plurality of heat exchange means for use either in a water-evaporative steam loop, or in a water-superheated steam loop in the thermodynamic steam cycle. By so providing such a plurality of heat exchange means in the isolatable segments of the bubbling bed of hot solids, flue gas temperatures in the furnace volume may be effectively controlled, thereby allowing the bubbling fluidized bed combustion system to be operated at lower flue gas temperatures and reducing the aforesaid fouling of convective heat exchange means.

Still further, there has been provided, by way of such a new and improved bubbling fluidized bed combustion system, a deentrainment zone disposed in the lower segment of the furnace volume and characterized by an increasing horizontal cross sectional area with increasing height within the furnace volume. By providing such a deentrainment zone larger particulate matter, i.e., larger unburned fuel particles, entrained within the upwardly mobile flue gases, fall out of the flue gas stream and are recirculated to the bubbling bed of hot solids for continued combustion, thereby increasing the residence time of a particle of fuel and providing for the greater likelihood of combustion of a particle of fuel. Furthermore, providing such a deentrainment zone reduces fouling of convective heat transfer surfaces as well as increases sulfur capture and carbon burnout.

Still further, there is provided a new and improved bubbling fluidized bed combustion system with freeboard heat exchange means disposed in the lower segment of the furnace volume above the deentrainment zone and capable of heat transfer duty either in a water-evaporative steam loop, or in a water-superheated steam loop in the thermodynamic steam cycle. Furthermore, such additional heat exchange means are disposed vertically and parallel to the flow of the upwardly mobile flue gases and act to remove heat therein released thereto due to the combustion of shale oil providing effective control of the temperature of the upwardly mobile flue gases in the furnace volume so as to allow the fluidized bed combustion system to be operated at lower flue gas temperatures, thus reducing the potential for the aforesaid fouling of convective heat exchange means.

There has also been provided in the present invention a fluidized bed ash cooler incorporated as an integral part thereof wherein the fluidized bed ash cooler acts as a heat exchanger capable of accepting as input thereto relatively hot ash particles, originating from the bubbling bed of hot solids and resulting from the incomplete combustion of oil shale within the furnace volume, and relatively cool air, for exchanging heat therein with the aforesaid relatively hot ash particles whereupon, the now hotter air is delivered therefrom to either the aforesaid bubbling bed of hot solids or to an overbed air inlet means disposed above the bubbling bed of hot solids in the lower segment of the furnace volume. By so providing such a fluidized bed ash cooler an exchange of heat between the air and the relatively hot ash recovers still useful energy from the ash for further use in the flue gas flow path or thermodynamic steam cycle, thus improving the efficiency of the bubbling fluidized bed combustion system. Such a fluidized bed ash cooler is capable of classifying finer ash particles from coarser ash particles and returning the finer ash particles directly to the bubbling bed of hot solids while yet delivering the coarser ash particles to an ash discharge means. Furthermore, such a fluidized bed ash cooler includes a plurality of isolatable segments thereof and is capable of performing heat transfer duty either in a water-evaporative steam loop, or in a water-superheated steam loop in the aforesaid thermodynamic steam cycle. Said fluidized bed ash cooler is capable of being slumped, i.e., capable of having one or more of said segments thereof isolated and made inoperative for the purpose of operating the bubbling fluidized bed combustion system so as to effectively respond to changing demands placed thereupon, while yet maintaining the aforesaid classification capability.

Furthermore, there has been provided such a new and improved bubbling fluidized bed combustion system possessing a multi-chambered upper segment of the furnace volume; each chamber therein being in fluid communication with the lower segment of the furnace volume. In particular, such a multi-chambered upper segment of the furnace volume has been provided that comprises for example two chambers whereby a first chamber thereof contains a plurality of superheat heat exchange means in fluid communication therebetween and integral to the aforesaid thermodynamic steam cycle and a second chamber thereof contains a plurality of reheat heat exchange means in fluid communication therebetween and integral to the thermodynamic steam cycle. Still further, such a multi-chambered upper segment of the furnace volume has been provided that has operatively connected thereto, means for controlling the distribution of the flow of the aforesaid upwardly mobile flue gases between and through the first and second chambers thereof, thereby affording a method of controlling the reheated steam outlet temperature of the thermodynamic steam cycle.

There has also been provided in the new and improved bubbling fluidized bed combustion system of the present invention an underbed air inlet means connected to the lower segment of the furnace volume and operative to properly fluidize the bubbling bed of hot solids by delivering upwardly mobile fluidizing air to the fluidized bed at a prescribed fluidizing velocity. By so providing such an underbed air inlet means and controlling the volumetric flow rate of the fluidizing air thereto, proper control of the flue gas temperature may be maintained and mechanical agitation of the fluidized bed may be effected to reduce agglomeration of the bed solids.

Still further there has been provided in the bubbling fluidized bed combustion system of the present invention an overbed air inlet means operative to deliver air to the furnace volume through which, by the judicious manipulation and control thereof, proper control may then be had of the stoichiometric ratio of the combustion process in the furnace volume, thus controlling $NO_x$ emissions therefrom.

Yet further, there has been provided in the present invention, such a new and improved bubbling fluidized bed combustion system possessing an overbed fuel inlet means disposed in the lower segment of the furnace volume above the bubbling bed of hot solids and operative to spread shale oil evenly over the bubbling bed of hot solids.

There is also provided in the new and improved bubbling fluidized bed combustion system of the present invention an ash drainage means disposed in the lower segment of the furnace volume proximate in elevation with the bubbling bed of hot solids yet disposed opposite from the overbed fuel inlet means in the furnace volume.

Yet further, the new and improved bubbling fluidized bed combustion system of the present invention is capable of the combustion of shale oil therein and the generation of steam thereby without the need for incorporating in the fluidized bed combustion system a solids/gas separator.

Still further, the new and improved bubbling fluidized bed combustion system of the present invention possesses a backpass volume in fluid communication with the furnace volume containing a plurality of economizer heat exchange means, in fluid communication therebetween and integral to the thermodynamic steam cycle, and an air preheater means for heating air prior to injection thereof into the furnace volume via the underbed air inlet means.

While several embodiments of our invention have been shown, it will be appreciated that modifications thereof, some of which have been alluded to hereinabove, may still be readily made thereto by those skilled in the art. We therefore intend by the appended claims to cover the modifications alluded to herein as well as all other modifications which fall within the true spirit and scope of our invention.

What is claimed is:

1. A fluidized bed combustion system having a thermodynamic steam cycle and a flue gas flow path acting in cooperative association therebetween for effecting the combustion of fuel therein including oil shale and the generation of steam thereby, said fluidized bed combustion system comprising:

a. a furnace volume defined by a plurality of waterwall tubes integral to the thermodynamic steam cycle and embodying therewithin
   - a lower segment thereof for the combustion of oil shale therein generating upwardly mobile flue gases thereby and
   - an upper segment thereof in fluid flow relation with said lower segment;

b. a fluidized bed ash cooler operative as a heat exchanger in fluid communication with said furnace volume;

c. fuel supply means in fluid communication with said furnace volume for delivering oil shale thereto for combustion therein;

d. a deentrainment zone disposed in said lower segment of the furnace volume for deentraining particulate matter generated from said combustion and entrained within said upwardly mobile flue gases such that substantially all of said particulate matter is retained within the furnace volume, said furnace volume including a fluidized bed composed of bed solids and underbed air inlet means connected to said lower segment of the furnace volume and operative to inject upwardly flowing fluidizing air thereinto at a velocity of at least 10 feet per second, and the deentrainment zone being disposed above said fluidized bed in which some of said bed solids rise and subsequently return downwardly to said fluidized bed and said fluidized bed having a height below which said bed solids do not rise into said deentrainment zone;

e. a backpass volume defined by a plurality of backpass wall tubes integral to the thermodynamic steam cycle, said backpass volume connected in fluid flow relation with the furnace volume and said furnace volume being operated such that a fraction of said particulate matter does not exit said furnace volume via said backpass volume and another fraction of said particulate matter exits said furnace volume via said backpass volume such that the percentage of the particulate matter which does not exit said furnace volume via said backpass volume is at least ninety-five percent of the total quantity of the particulate matter and the particulate matter which has exited said furnace volume via said backpass volume is subjected to electrostatically based separation before a selected one of additional separation by cyclonic based separation and no additional separation by cyclonic based separation, said backpass volume including means disposed therein for preheating air, said means having operatively connected thereto air inlet means and fluidizing air outlet means, said fluidizing air outlet means in fluid flow relation with said underbed air inlet means;

f. a plurality of circulatory fluid flow paths integral to the thermodynamic steam cycle and operative to conduct the flow of steam or water therethrough, said plurality of circulatory fluid flow paths including a steam drum for separating steam from water, at least one circulatory fluid flow path integral to the thermodynamic steam cycle and operative as a water-evaporative steam loop including said waterwall tubes, means for conveying water from the steam drum thereto, means for conveying a mixture of water and steam therefrom to the steam drum, a circulatory fluid flow path integral to the thermodynamic steam cycle and operative as a water-superheated steam loop including at least one superheat heat exchange means, means for conveying steam from the steam drum thereto, a high pressure turbine, means for conveying steam from the at least one superheat heat exchange means thereto, a condenser, means for conveying steam from the high pressure turbine thereto, a fluid conveying means, means for conveying steam from the condenser thereto, at least one economizer heat exchange means, means for conveying steam from the fluid conveying means thereto, means for conveying steam from the at least one economizer heat exchange means to the steam drum, feedwater supply means, and means for conveying feedwater from the feedwater supply means to the steam drum; and g. ash discharge means for discharging ash from the fluidized bed into an area other than the backpass volume, said ash discharge means being operative to discharge the particulate matter from the furnace volume such that said height of the fluidized bed does not increase more than twenty percent during operation of the fluidized bed combustion system.

2. The fluidized bed combustion system as set forth in claim 1 wherein said furnace volume includes air distribution means disposed within the lower segment of the furnace volume below said deentrainment zone, said air distribution means operative to distribute the upwardly flowing fluidizing air evenly across the lower segment of the furnace volume;

a fluidized bed composed of bed solids and disposed within the lower segment of the furnace volume above said air distribution means including a first plurality of isolatable segments, first ash discharge means for discharging relatively hot ash therefrom and first ash inlet means;

overbed air inlet means connected to the lower segment of the furnace volume above said fluidized bed operative to inject overbed air thereinto to support the combustion of oil shale therein;

fluidized bed air inlet means connected to the lower segment of the furnace volume proximate in elevation to said fluidized bed operative to inject fluidized bed air thereto to support the combustion of oil shale therein;

a plurality of freeboard heat exchange means integral to the thermodynamic steam cycle and disposed in the lower segment of the furnace volume above the deentrainment zone parallel to the flow of the upwardly mobile flue gases;

means operatively connected to the upper segment of the furnace volume for controlling the distribution of the flow of the upwardly mobile flue gases therethrough;

a plurality of fuel inlet means disposed at the lower segment of the furnace volume proximate in elevation to said overbed air inlet means above said fluidized bed opposite said first ash discharge means; and means for conveying oil shale as a combustible fuel from said fuel supply means to said plurality of fuel inlet means.

3. The fluidized bed combustion system as set forth in claim 2 wherein said deentrainment zone has an increasing horizontal cross sectional area with increasing height within the furnace volume and the percentage of said particulate matter retained within the furnace volume is at least ninety-five percent and the percentage of particulate matter exiting the furnace volume is no more than five percent, said particulate matter exiting the furnace volume is not returned to the furnace volume and said particulate matter exiting the furnace volume is not subject to cyclonic separation and is subject to separation from said flue gases by electrostatic means.

4. The fluidized bed combustion system as set forth in claim 3 wherein said fluidized bed ash cooler includes a second plurality of isolatable segments, second ash inlet means connected in fluid flow relation with the first ash discharge means for accepting relatively hot ash therefrom, second ash discharge means connected in fluid flow relation with the first ash inlet means, air inlet means and a plurality of air outlet means in fluid flow relation with said overbed air inlet means and said fluidized bed air inlet means, a plurality of means for conveying water from the steam drum thereto, a plurality of means for conveying a mixture of water and steam therefrom to the steam drum.

5. The fluidized bed combustion system as set forth in claim 1 wherein the at least one circulatory fluid flow path integral to the thermodynamic steam cycle and operative as a water-evaporative steam loop comprises a plurality of circulatory fluid flow paths integral to the thermodynamic steam cycle and operative as a plurality of water-evaporative steam loops including a plurality of evaporative heat exchange means, a plurality of means for conveying water from the steam drum thereto, plurality of means for conveying a mixture of water and steam therefrom to the steam drum.

6. The fluidized bed combustion system as set forth in claim 5 wherein said means for conveying steam from the high pressure turbine to the condenser includes at least one reheat heat exchange means, means for conveying steam from the high pressure turbine thereto, a low pressure turbine, means for conveying steam from the at least one reheat heat exchange means thereto, means for conveying steam from the low pressure turbine to the condenser.

7. The fluidized bed combustion system as set forth in claim 5 wherein the plurality of evaporative heat exchange means comprise up to three evaporative heat exchange means, the at least one superheat heat exchange means comprises up to five superheat heat exchange means in fluid communication therebetween, the at least one reheat heat exchange means comprises up to four reheat heat exchange means in fluid communication therebetween and the at least one economizer heat exchange means comprises up to four economizer heat exchange means in fluid communication therebetween.

8. The fluidized bed combustion system as set forth in claim 7 wherein a first superheat heat exchange means of the up to five superheat heat exchange means is the steam cooled backpass wall tubes and a second superheat heat exchange means thereof is disposed in a first segment of the plurality of isolatable segments of the fluidized bed ash cooler and a third superheat heat exchange means thereof is a first heat exchange means of the plurality of freeboard heat exchange means and a fourth superheat heat exchange means thereof is disposed in a first chamber of the upper segment of the furnace volume and a fifth superheat heat exchange means thereof is disposed in a first segment of the plurality of isolatable segments of the fluidized bed; wherein a first reheat heat exchange means of the up to four reheat heat exchange means is disposed in a second segment of the plurality of isolatable segments of the fluidized bed ash cooler and a second reheat heat exchange means thereof is a second heat exchange means of the plurality of freeboard heat exchange means and a third reheat heat exchange means thereof is disposed in a second chamber of the upper segment of the furnace volume and a fourth reheat heat exchange means thereof is disposed in a second segment of the plurality of isolatable segments of the fluidized bed; wherein a first economizer heat exchange means of the up to four economizer heat exchange means is a third heat exchange means of the plurality of freeboard heat exchange means and a second economizer heat exchange means thereof is disposed in a third segment of the plurality of isolatable segments of the fluidized bed ash cooler and a third economizer heat exchange means thereof is disposed in a third segment of the plurality of isolatable segments of the fluidized bed and a fourth economizer heat exchange means thereof is the at least one economizer heat exchange means; and wherein a first evaporative heat exchange means of the plurality of evaporative heat exchange means is a fourth heat exchange means of the plurality of freeboard heat exchange means and a second evaporative heat exchange means thereof is disposed in a fourth segment of the plurality of isolatable segments of the fluidized bed ash cooler and a third evaporative heat exchange means thereof is disposed in a fourth segment of the plurality of isolatable segments of the fluidized bed.

9. The fluidized bed combustion system as set forth in claim 1 wherein said means for conveying steam from the high pressure turbine to the condenser includes at least one reheat heat exchange means, means for conveying steam from the high pressure turbine thereto, a low pressure turbine, means for conveying steam from the at least one reheat heat exchange means thereto, means for conveying steam from the low pressure turbine to the condenser.

* * * * *